US010192533B2

(12) United States Patent
Hamano et al.

(10) Patent No.: US 10,192,533 B2
(45) Date of Patent: Jan. 29, 2019

(54) CONTROLLER AND SYSTEM FOR VOICE GENERATION BASED ON CHARACTERS

(71) Applicant: Yamaha Corporation, Hamamatsu-shi, Shizuoka-ken (JP)

(72) Inventors: Keizo Hamano, Hamamatsu (JP); Kazuki Kashiwase, Hamamatsu (JP); Yoshitomo Ota, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/530,259

(22) PCT Filed: Jun. 10, 2015

(86) PCT No.: PCT/JP2015/066659
§ 371 (c)(1),
(2) Date: Dec. 17, 2016

(87) PCT Pub. No.: WO2015/194423
PCT Pub. Date: Dec. 23, 2015

(65) Prior Publication Data

US 2017/0169806 A1 Jun. 15, 2017

(30) Foreign Application Priority Data

Jun. 17, 2014 (JP) ..... 2014-124091
Jun. 17, 2014 (JP) ..... 2014-124092

(51) Int. Cl.
*G10H 1/00* (2006.01)
*G10H 1/18* (2006.01)
(Continued)

(52) U.S. Cl.
CPC ..... *G10H 1/0008* (2013.01); *G10H 1/053* (2013.01); *G10L 13/0335* (2013.01);
(Continued)

(58) Field of Classification Search
CPC ..... G10L 13/033; G10L 13/0335; G10H 2250/455; G10H 2240/141; G10H 2220/011
See application file for complete search history.

(56) References Cited

U.S. PATENT DOCUMENTS 5,430,240 A * 7/1995 Okamoto ..... G10H 1/348 84/600
5,477,003 A * 12/1995 Muraki ..... G10H 1/366 434/307 A
(Continued)

FOREIGN PATENT DOCUMENTS

EP 1 455 340 A1 9/2004
EP 2 733 696 A1 5/2014
(Continued)

OTHER PUBLICATIONS

International Search Report dated Aug. 25, 2015, for PCT Application No. PCT/JP2015/066659, four pages.
(Continued)

*Primary Examiner* — Marlon Fletcher
(74) *Attorney, Agent, or Firm* — Morrison & Foerster LLP

(57) ABSTRACT

A voice generation device (10*b*) is configured to generate a voice corresponding to one or a plurality of characters designated in a pre-defined character string. A controller (10*a*) for the voice generation device is provided with a character selector (60*a*) configured to be operable by a user to designate the one or a plurality of characters in the character string, and a voice control operator (60*b*) configured to be operable by the user to control the state of the voice to be generated by the voice generation device. The controller (10*a*) is provided with a grip (G) suitable for being held with a hand of the user, and the character selector and the voice control operator are provided on the grip. The
(Continued)

character selector and the voice control operator are provided on the grip at such positions as to be operable with different fingers of the user holding the grip.

20 Claims, 9 Drawing Sheets

(51) Int. Cl.
*G10H 5/00* (2006.01)
*G10H 1/053* (2006.01)
*G10L 13/10* (2013.01)
*G10L 13/033* (2013.01)

(52) U.S. Cl.
CPC ..... *G10L 13/10* (2013.01); *G10H 2220/315* (2013.01); *G10H 2250/455* (2013.01)

(56) References Cited

U.S. PATENT DOCUMENTS 5,705,762 A * 1/1998 Kang ..... G10H 1/368 84/610
5,847,303 A * 12/1998 Matsumoto ..... G10H 1/365 204/207
5,875,427 A 2/1999 Yamazaki
5,889,223 A * 3/1999 Matsumoto ..... G10H 1/366 434/307 A
6,307,140 B1 * 10/2001 Iwamoto ..... G10H 1/36 84/622
7,365,260 B2 * 4/2008 Kawashima ..... G10H 1/0041 704/258
2003/0159568 A1 * 8/2003 Kemmochi ..... G10H 7/00 84/626
2005/0257667 A1 * 11/2005 Nakamura ..... G10H 1/0008 84/609
2009/0165634 A1 * 7/2009 Mahowald ..... G10H 1/368 84/610
2013/0019738 A1 * 1/2013 Haupt ..... G10H 1/06 84/622
2014/0006031 A1 * 1/2014 Mizuguchi ..... G10L 13/04 704/260
2015/0040743 A1 * 2/2015 Tachibana ..... G10H 1/361 84/622

FOREIGN PATENT DOCUMENTS

JP S-64-38792 A 2/1989
JP H-05-341777 A 12/1993
JP H-06-118955 A 4/1994
JP 2005-189454 A 7/2005
JP 2008-170592 A 7/2008
JP 2009-258292 A 11/2009
JP 2014-010190 A 1/2014
WO WO-2014/088036 A1 6/2014

OTHER PUBLICATIONS

Notification of Reasons for Refusal dated Jan. 9, 2018, for JP Application No. 2016-529261, with English translation, six pages.
Extended European Search Report dated Feb. 21, 2018, for EP Application No. 15809992.9, 12 pages.

* cited by examiner

CONTROLLER AND SYSTEM FOR VOICE GENERATION BASED ON CHARACTERS

CROSS-REFERENCE TO RELATED APPLICATIONS

This application is a National Phase application under 35 U.S.C. § 371 of International Application No. PCT/JP2015/066659, filed Jun. 10, 2015, which claims priority benefit of Japanese Patent Application No. 2014-124091, filed Jun. 17, 2014 and Japanese Patent Application No. 2014-124092, filed Jun. 17, 2014, the contents of which are hereby incorporated by reference in their entireties for all intended purposes.

TECHNICAL FIELD

The present invention relates to a technique for generating, with a designated pitch, a voice based on a character.

BACKGROUND ART

There have heretofore been known apparatus which generate singing voices by synthesizing voices of lyrics while varying a pitch in accordance with a melody. Patent Literature 1, for example, discloses a technique for updating or controlling a singing position in lyrics, indicated by lyrics data, in response to receipt of performance data (pitch data). Namely, Patent Literature 1 discloses a technique in which a melody performance is executed by a user operating an operation section, such as a keyboard, and the lyrics are caused to progress in synchronism with a progression of the melody performance. Further, in the field of electronic musical instruments, controllers of various shapes have been under development, and it has been known to provide a grip section projecting from the body of a keyboard musical instrument and provide, on the grip section, a desired operation section and an appropriate detection section for detecting a manual operation performed on the operation section (see, for example, Patent Literature 2 and Patent Literature 3).

Further, Patent Literature 4, for example, discloses a technique in which a plurality of lyrics are displayed on a display device, a desired portion of the lyrics is selected through an operation of an operation section, and the selected portion is output as a singing voice of a designated pitch. Patent Literature 4 also discloses a construction in which a user designates a syllable of the lyrics displayed on a touch panel, and then, once the user performs key depression successively three times on a keyboard, the designated syllable is audibly generated or sounded with a pitch designated on the keyboard.

PRIOR ART LITERATURE

Patent Literature

Patent Literature 1: Japanese Patent Application Laid-open No. 2008-170592

Patent Literature 2: Japanese Patent Application Laid-open No. HEI-01-38792

Patent Literature 3: Japanese Patent Application Laid-open No. HEI-06-118955

Patent Literature 4: Japanese Patent Application Laid-open No. 2014-10190

In the conventionally-known apparatus which generate voices on the basis of characters, such as singing voice generation device, various performance expressions, like user expressions, achievable by the voice generation, are undesirably considerably limited in width or range. Specifically, in live performances, it is desirable to permit flexible modification of the lyrics and/or control of a style or manner (state) of voice generation, i.e. flexible ad-lib performances, such as repeating a phrase of a desired portion of the lyrics in accordance with warming-up or climaxing of the music piece and/or changing, even where the same phrase is repeated, the lyrics expressions, intonations of the performance and/or the like per repetition of the phrase as necessary. However, with the conventionally-known apparatus, it is not possible to easily execute such flexible ad-lib performances. For example, it is not easy to flexibly control the manner of the voice generation, such as by making a setting such that a user-desired partial range of the music piece is repeated during the performance, or changing, in a case where the same phrase is repeated, the lyrics and/or intonation per repetition.

Besides, there has heretofore been a demand for development of various techniques for allowing an object of repeat to be selected with ease. Namely, in order to repeat the lyrics in the technique disclosed in Patent Literature 4, it is necessary to select the lyrics displayed on the display section. However, it is also necessary to view the display section while singing voices are being output. Further, when an operation for selecting the displayed lyrics is required, the performing style of a human player would be limited to one that permits the viewing of the display section and lyrics selecting operation. During a live performance, of a performance device provided with a display section, for example, it is essential for the human player to view the performance device provided with the display section. Therefore, it tends to be difficult for the human player to perform the performance device by touching the performance device without relying on the sense of vision, and thus, the range of motion, performance posture, etc. of the user would be limited to those that permit the viewing of the display section and selection operation.

SUMMARY OF INVENTION

In view of the foregoing prior art problems, it is an object of the present invention to provide a technique which generates voices based on a pre-defined character string, such as lyrics, in accordance with performed pitches, and which permits an ad-lib performance, such as a change of a voice to be generated and thereby permits an increased range of expressions in the character-based voice generation. It is another object of the present invention to permit selection of an object of repeat without relying on the sense of vision.

In order to accomplish the aforementioned object, the present invention provides a controller for a voice generation device, the voice generation device being configured to generate a voice corresponding to one or more designated characters in a pre-defined character string, the controller comprising: a character selector configured to be operable by a user to designate the one or more designated characters in the pre-defined character string; and a voice control operator configured to be operable by the user to control a state of the voice to be generated by the voice generation device. The present invention also provides a system comprising the aforementioned controller and the aforementioned voice generation device.

According to the present invention, where a voice corresponding to the one or more characters designated from the pre-defined character string in response to a user's operation of the character selector is generated by the voice generation device and the voice to be generated can be controlled as desired in response to a user's operation of the voice control operator, the voice to be generated can be changed or the like in accordance with a user's operation although the present invention is constructed to generate voices based on the pre-defined character string. Thus, in the case where voices corresponding to characters of lyrics are to be generated in synchronism with a music performance, controllability by the user can be enhanced, which can thereby facilitate an ad-lib performance in lyrics-based voice generation. In this way, the present invention can significantly increase a width or range of expressions in the lyrics-based voice generation.

In one embodiment of the present invention, the controller further comprises a grip adapted to be held with a hand of the user, and the character selector and the voice control operator are both provided on the grip. In one embodiment, the character selector and the voice control operator are provided on the grip at positions where the character selector and the voice control operator are operable with different fingers of the user holding the grip. Further, in one embodiment, the controller is constructed in such a manner that one of the character selector and the voice control operator is operable with the thumb of the user and the other of the character selector and the voice control operator is operable with another finger of the user. Further, in one embodiment, the character selector and the voice control operator are disposed on different surfaces of the grip. The construction where the character selector and the voice control operator are disposed on the single grip in the aforementioned manner is suited for the user to appropriately operate both of the character selector and the voice control operator using any of the fingers of one hand of the user holding the grip. Thus, the user can easily operate the character selector and the voice control operator on the grip with one hand while performing a keyboard musical instrument or the like with the other hand.

According to another aspect of the present invention, there is provided a voice generation device which comprises a processor configured to function as: an information acquisition section that acquires information designating one or more characters in a pre-defined character string; a voice generation section that generates, based on the acquired information, a voice corresponding to the designated one or more characters; an object-of-repeat reception section that receives information designating a currently-generated voice as an object of repeat; and a repeat control section that controls the voice generation section to repeatedly generate the voice designated as the object of repeat. Thus, by listening to voices sequentially generated by the voice generated by the voice generation section, the user can quickly auditorily judge whether the voice being currently generated in real time is suited to be designated as an object of repeat and then designate (select) the currently-generated voice as an object of repeat. In this way, the user can select a character as the object of repeat, without relying on the auditory sense.

DESCRIPTION OF EMBODIMENTS

(1) System Construction

Figure 1A:
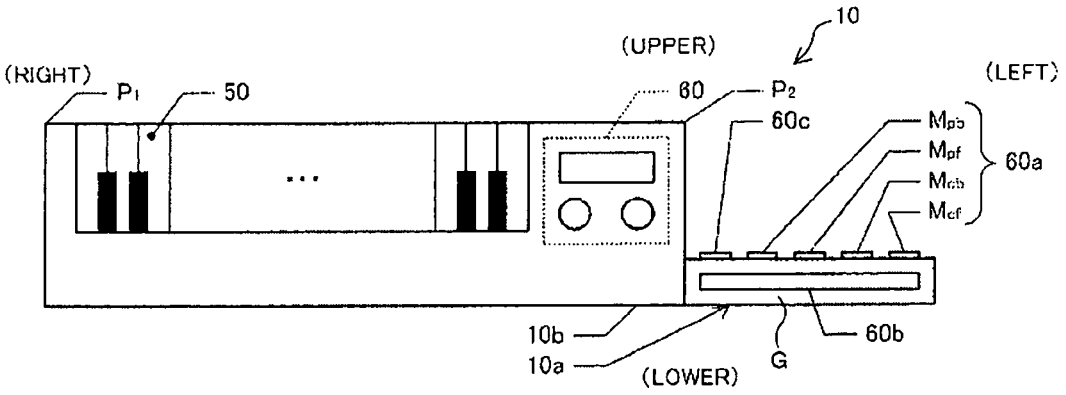
FIG. 1A is a view schematically showing a keyboard musical instrument as a system provided with a controller according to an embodiment of the present invention.

FIG. 1A is a view schematically showing an electronic keyboard musical instrument 10 as a system provided with a controller 10*a* according to an embodiment of the present invention and a voice generation device 10*b*. The keyboard musical instrument 10 includes a body 10*b* of a rectangular parallelepiped shape, and the controller 10*a* of a rectangular cylindrical shape. The body 10*b* of the keyboard musical instrument 10 functions as an example of the voice generation device that electronically generates desired tones and desired voices, and the body 10*b* includes a pitch selector 50 and an input/output section 60. The pitch selector 50, which is an operator operable by a user to designate a tone or voice to be played or performed, comprises, for example, a plurality of keys including white and black keys. A not-shown shoulder strap is connectable to mounting positions $P_1$ and $P_2$ at the opposite ends of the body 10*b* of the keyboard musical instrument 10. The user can hold the keyboard musical instrument 10 in front of his or her body with the shoulder strap slung over the user's shoulders, in which state the user can execute a performance by operating the pitch selector (keyboard) 50 with one hand. In FIG. 1A, "upper", "lower", "right" and "left" refer to directions as viewed from the user playing or performing the keyboard musical instrument 10 in the aforementioned manner. Various directions hereinafter mentioned in this specification means upward, downward, leftward, rightward, forward, rearward (backward) directions etc. as viewed from the user performing the keyboard musical instrument 10. The pitch selector 50 is not necessarily limited to a keyboard-type pitch designating performance operator and may be any desired type of performance operator, as long as it is configured to designate a pitch in response to a user's operation.

Further, the input/output section 60 comprises an input section that inputs an instruction given from the user etc., and an output section (including a display and a speaker) that outputs to the user various information (image information and voice information). As an example, rotary switches and a display are provided as the input section and the output section, respectively, on the keyboard musical instrument 10 and depicted within a dotted-line block in FIG. 1A.

The controller 10*a* projects from one side surface (left side surface in the illustrated example of FIG. 1A) of the body (voice generation device) 10*b* in a direction perpendicular to the one side surface (i.e., projects leftward from the one side surface as viewed from the user performing the keyboard musical instrument 10). The controller 10*a* has a substantially columnar contour. An outer peripheral portion of the controller 10*a* has a size such that the user can hold the controller 10*a* with one hand; thus, the portion of the controller 10*a* projecting from the body 10*b* constitutes a grip G A cross-section cut across the grip G perpendicularly to the longitudinal axis (i.e. axis extending in a left-right direction in FIG. 1A) of the grip G has a uniform shape irrespective of the cut-across position of the grip G. As noted later, the controller 10*a* may be joined integrally to and undetachably from the body (voice generation device) 10*b*, detachably attached to the body (voice generation device) 10*b*, or provided separately from the body (voice generation device) 10*b* in such a manner that it can communicate with the body (voice generation device) 10*b* in a wired or wireless fashion.

Figure 1B:
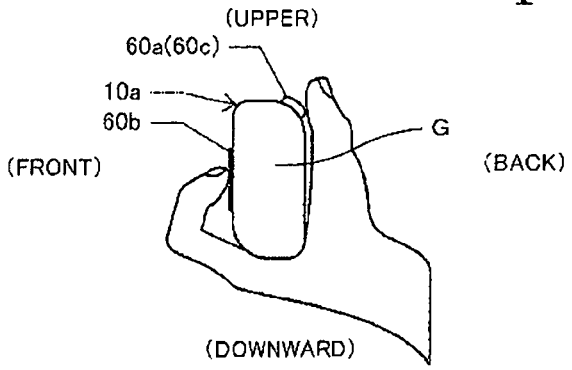
FIG. 1B is a view showing a grip of the controller held or grasped by a user.

FIG. 1B is a schematic view of the controller 10*a* as seen from the left side of FIG. 1A, which more particularly shows an example state of the grip G held by the user. As shown in FIG. 1B, a cross-section of the grip G, cut across the grip G perpendicularly to the longitudinal axis, has a substantially rectangular shape with rounded four corner portions. Namely, the grip G has a shape with front, rear (back), upper and lower flat surfaces and curved or slanting surfaces between the front, rear, upper and lower flat surfaces (i.e., a chamfered shape).

On the grip G of the controller 10*a* are provided a character selector 60*a* capable of functioning as a part of the input/output section 60 of the keyboard musical instrument 10, a voice control operator 60*b*, and a repeat operator 60*c*. Namely, a signal and/or information generated in response to an operation of any of the character selector 60*a*, voice control operator 60*b* and repeat operator 60*c* on the controller 10*a* is transferred to the body (voice generation device) 10*b* of the keyboard musical instrument 10, where the signal and/or information is handled as a user-input signal and/or information. The character selector 60*a*, which is configured to be operable by the user to designate one or more characters included in a pre-defined character string (such as lyrics), includes a plurality of selection buttons Mcf, Mcb, Mpf and Mpb that are in the form of push button switches. The character selector 60*a* is disposed on the curved or slanting surface (chamfered part) formed between the upper flat surface and the rear flat surface (see FIG. 1B). With the character selector 60*a* disposed in the aforementioned manner, the user can easily operate the character selector 60*a* with the thumb of the hand holding the grip G.

The repeat operator 60*c* is operable by the user to enter repeat-performance-related input. In the instant embodiment, the repeat operator 60*c*, which is also in the form of a push button switch, is disposed on the curved or slanting surface (chamfered part) formed between the upper flat surface and the rear flat surface (see FIG. 1B). In the instant embodiment, the individual buttons Mcf, Mcb, Mpf and Mpb of the character selector 60*a* and the button of the repeat operator 60*c* are disposed on the curved or slanting surface (chamfered part) in a row along the extending direction of the grip G (i.e., in the left-right direction shown in FIG. 1A).

The voice control operator 60*b* is configured to be operable by the user to control the state of the voice to be generated by the voice generation device 10*b*. As an example, the pitch of the voice to be generated is controllable in response to an operation of the voice control operator 60*b*. The voice control operator 60*b* is disposed on the front flat surface of the grip G (see FIG. 1B). The voice control operator 60*b* is, for example, in the form of a touch sensor of an elongated thin film shape, which is configured to detect a touch-operating or touching contact position (e.g., one-dimensional position in the longitudinal direction), on an operating surface of the operator 60*b*, of an object of detection (that is a user's finger in the instant embodiment). In the instant embodiment, the voice control operator 60*b* is disposed on the front surface of the grip G in such a manner that the short sides of the touch sensor of a rectangular shape are opposed parallel to each other in the upper-lower (up-down) direction while the long sides of the rectangular shape are opposed parallel to each other in the left-right direction (see FIG. 1A).

In the above-described construction, the user operates the character selector 60*a*, voice control operator 60*b* and repeat operator 60*c* while holding the grip G of the controller 10*a* with the left hand as shown in FIG. 1B. More specifically, the user holds the grip G while supporting from below the grip G on the palm of the left hand with the thumb of the left hand positioned on the rear surface of the grip G and other fingers of the left hand positioned on the front surface of the grip G. In this state, the character selector 60*a* and the repeat operator 60*c* are located at positions where the user is allowed to easily operate the operators 60*a* and 60*c* with the thumb as shown in FIG. 1B, because these operators 60*a* and 60*c* are located on the curved or slanting surface between the rear surface and the upper surface of the grip G.

Further, when the user is holding the grip G as shown in FIG. 1B, the voice control operator 60*b* is located at a position where the user is allowed to easily operate the operator 60*b* with a finger (such as an index finger) other than the thumb as shown in FIG. 1B, because the operator 60*b* is disposed on the front surface of the grip G. Thus, in the instant embodiment, the voice control operator 60*b* is provided at a position where the other finger is located when the user operates the character selector 60*a* or the repeat operator 60*c* with the thumb while holding the grip G.

Further, according to the above-described construction, the user can operate the character selector 60*a* or the repeat operator 60*c* with the thumb of the one hand and operate the voice control operator 60*a* with another finger of the one hand while holding the grip G of the controller 10*a* with the one hand. Thus, the user can readily simultaneously operate, with the one hand, the voice control operator 60*b* and the character selector 60*a* (or the repeat operator 60*c*). Further, the user's operation on the voice control operator 60*b* with the one hand is similar to an operation of holding a guitar fret or the like; thus, by the user touching the voice control operator 60*b* with an operation similar to the guitar fret holding operation, the manner of voice generation can be controlled in accordance with the user's touch-operating or touching contact position on the voice control operator 60*b*. Further, when the user is holding the controller 10*a*, the user's hand contacts only the flat, curved or slanting surfaces of the controller 10*a* without contacting any pointed portion of the controller 10*a*. Thus, the user can slidingly move the hand repeatedly along the longitudinal direction (i.e., left-right direction in FIG. 1A) of the voice control operator 60*b* without injuring the hand. Note that the positioning of the character selector 60*a* and the voice control operator 60*b* for allowing the user to simultaneously operate these operators 60*a* and 60*b* is not necessarily limited to the illustrated example and may be any other positioning as long as the user can simultaneously operate one of the character operator 60*a* and voice control operator 60*b* with a finger of the user's hand holding the grip G and operate the other of the operators 60*a* and 60*b* with another finger of the same hand.

Figure 1C:
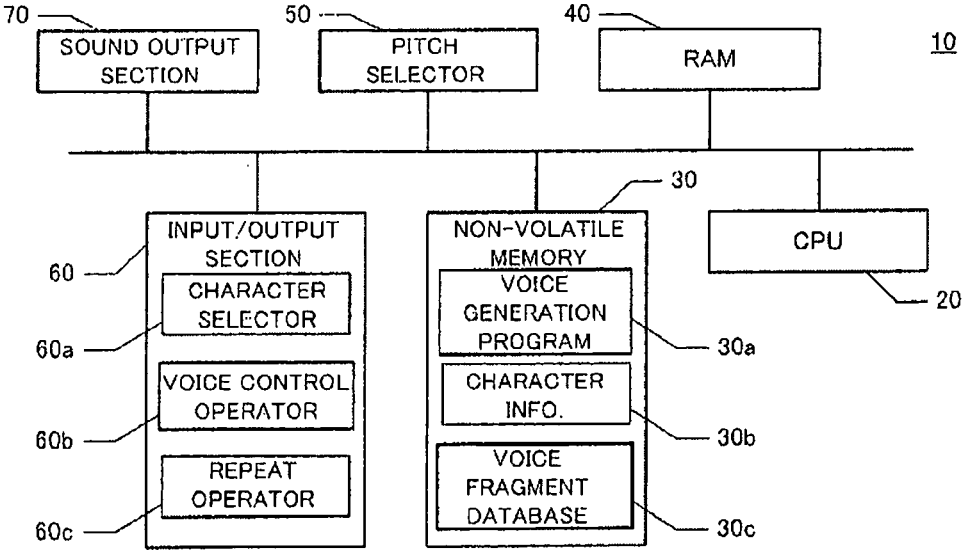
FIG. 1C is a block diagram showing a control system of the keyboard musical instrument.

FIG. 1C is a block diagram showing a construction employed in the keyboard musical instrument 10 for generating and outputting a voice. As shown in FIG. 1C, the keyboard musical instrument 10 includes a CPU 20, a non-volatile memory 30, a RAM 40, the pitch selector 50, the input/output section 60, and a sound output section 70. The sound output section 70 may include a circuit for outputting a voice, and a speaker (not shown in FIG. 1A). The CPU 20 is capable of executing programs, stored in the non-volatile memory 30, using the RAM 40 as a temporary storage area.

Further, a voice generation program 30*a*, character information 30*b* and a voice fragment database 30*c* are recorded in advance in the non-volatile memory 30. The character information 30*b* is information of a pre-defined character string, such as lyrics, which includes, for example, information of a plurality of characters constituting the character string and information indicative of an order of the individual characters in the character string. In the instant embodiment, the character information 30*b* is in the form of text data where codes indicative of the characters are described in accordance with the above-mentioned order. Needless to say, the data of the lyrics prestored in the non-volatile memory 30 may be of only one or a plurality of music pieces, or just one phrase of a portion of a music piece. When voices of a desired song or character string are to be generated, the character information 30*b* of the music piece, i.e. the character string, is selected. Further, the voice fragment database 30*c* is a collection of data for playing back or reproducing human singing voices, and in the instant embodiment, the voice fragment database 30*c* is created by collecting waveforms of voices, represented by characters, when the voices were uttered with reference pitches, segmenting each of the collected waveforms into voice fragments each having a short time period and then databasing waveform data indicative of the segmented voice fragments. Namely, the voice fragment database 30*c* comprises a collection of waveform data indicative of a plurality of voice fragments. Combining such waveform data indicative of voice fragments can reproduce voices indicated by desired characters.

More specifically, the voice fragment database 30*c* is a collection of waveform data of voice transition portions (articulations), such as C to V (i.e., Consonant-to-Vowel) transition portions, V to V (i.e., Vowel-to-another-Vowel) transition portions and V to C (Vowel-to-Consonant) transition portions, and waveform data of stretched sounds (stationaries) of vowels V. Namely, the voice fragment database 30*c* is a collection of voice fragment data indicative of various voice fragments as materials of singing voices. These voice fragment data are data created on the basis of voice fragments extracted from voice waveforms uttered by actual persons. In the instant embodiment, voice fragment data to be connected together for reproducing voices of desired characters or a desired character string are predetermined and prestored in the non-volatile memory 30 (although not particularly shown). The CPU 20 references the non-volatile memory 30 in accordance with desired characters or a desired character string indicated by the character information 30*b* to select voice fragment data to be connected together. Then, waveform data for reproducing voices indicated by the desired characters or desired character string are created by the CPU 20 connecting together the selected voice fragment data. Note that the voice fragment database 30*c* may be prepared for various different languages or for different characteristics of voices, such as the sexes of human voice utterers. Further, the waveform data constituting the voice fragment database 30*c* may each be data prepared by segmenting a train of samples, obtained by sampling the waveform of the voice fragment at a predetermined sampling rate, into frames each having a predetermined time length, or per-frame spectral data (of amplitude and phase spectra) obtained by performing the FFT (Fast Fourier Transform) on the data prepared by segmenting a train of samples. The following describe a case where the waveform data constituting the voice fragment database 30*c* are the latter data, i.e. spectral data.

In the illustrated embodiment, the CPU 20 can execute the voice generation program 30*a* stored in the non-volatile memory 30. Through execution of the voice generation program 30*a*, the CPU 20 generates, with pitches instructed by the user on the pitch selector 50, voice signals corresponding to characters defined as the character information 30*b*. Then, the CPU 20 instructs the sound output section 70 to output voices in accordance with the generated voice signals, in response to which the sound output section 70 generates analog waveform signals for outputting the voices and amplifies the analog waveform signals to audibly output the voices.

(2) Example of Character String

In the present invention, the pre-defined character string is not necessarily limited to lyrics of an existing song associated in advance with a predetermined music piece and may be any desired character string of a poem, a verse, an ordinary sentence or the like. In the following description, let it be assumed that voices corresponding to a character string of lyrics associated with a predetermined music piece are generated. As known, a progression of notes and a progression of lyrics in a music piece are associated with each other in a predetermined relationship. In such a case, a note may correspond to one syllable or a plurality of syllables, or it may sometimes correspond to a sustained portion of a syllable having been generated in correspondence to an immediately preceding note. As also known, the unit number of characters that can be associated with one note differs depending on the type of language. In Japanese, for example, each syllable can generally be expressed by one Japanese alphabetical letter (kana character), and thus, lyrics can be associated with individual notes on a kana-character-by-kana-character basis. In many of other languages, such as English, on the other hand, one syllable is generally expressed by one or a plurality of characters, and thus, lyrics are associated with individual notes on a syllable-by-syllable basis rather than on the character-by-character basis; namely, the number of characters constituting a syllable may be just one or plural (more than one). The concept derivable from the foregoing is that, in any language systems, the number of characters for designating a voice to be generated in correspondence to a syllable is one or plural. In this sense, the one or plural characters to be designated for generation of a voice in the present invention suffice to identify one or plural syllables (including a syllable with a consonant alone) necessary for the voice generation.

Figure 6A:
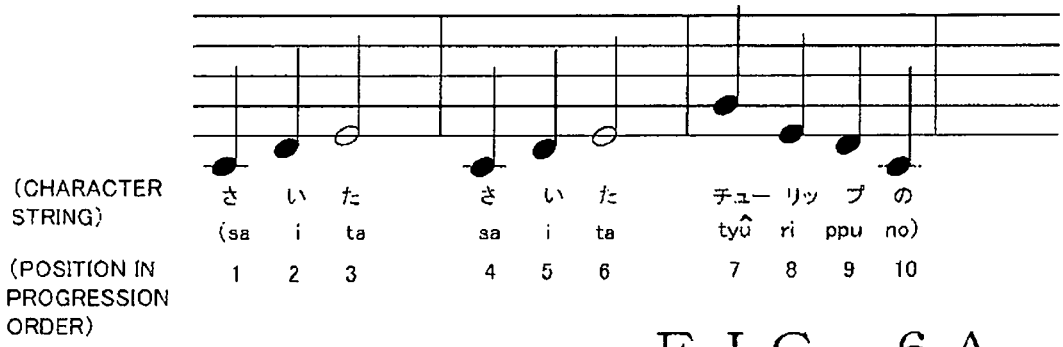
FIG. 6A is a diagram showing an example of a character string of Japanese Lyrics.
Figure 6B:
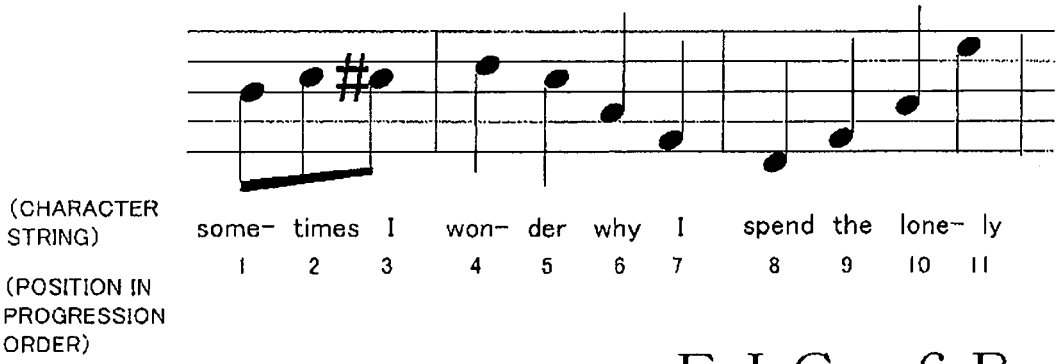
FIG. 6B is a diagram showing an example of a character string of English Lyrics.

As an example, a construction may be employed where, in synchronism with a user's pitch designation operation on the pitch selector 50, one or more characters in a character string (lyrics) are caused to sequentially progress in accordance with a predetermined character progression order of the character string (lyrics). For that purpose, the individual characters in the character string (lyrics) are divided into character groups, each comprising one or more characters, in association with respective notes to which the characters are allocated, and such groups are ordered in accordance with the progression order. FIGS. 6A and 6B show examples of ordering of such character groups. More specifically, FIG. 6A shows a character string of Japanese lyrics and notes of a melody corresponding to the character string on a staff notation, and FIG. 6B shows a character string of English lyrics and notes of a melody corresponding to the character string on a staff notation. In FIGS. 6A and 6B, numbers shown immediately below the individual character groups in the lyrics character strings indicate respective positions, in the progression order, of the character groups. The character information 30*b* recorded in the non-volatile memory 30 includes character data where the individual characters in the lyrics character string are readably stored in character groups each having one or more characters, and position data indicative of the respective positions, in the progression order, of the character groups. In the illustrated example of FIG. 6A, the character groups corresponding to positions (in-the-order positions) 1, 2, 3, 4, 5, 6, 9 and 10 each comprise a single character, and the character groups corresponding to positions (in-the-order positions) 7 and 8 each comprise a plurality of characters. In the illustrated example of FIG. 6B, on the other hand, the character groups corresponding to positions 1, 2, 4, 5, 6, 8, 9, 10 and 11 each comprise a plurality of characters, and the character groups corresponding to positions 3 and 7 each comprises a single character. Note that, because no note data (e.g., MIDI data) of the music piece is required in the present invention, the musical scores shown in the uppermost rows in FIGS. 6A and 6B are just for reference purposes. However, as a modification, note data (e.g., MIDI data) of the music piece may be used, as will be described later.

(3) Basic Example of Voice Generation Processing

Figure 3A:
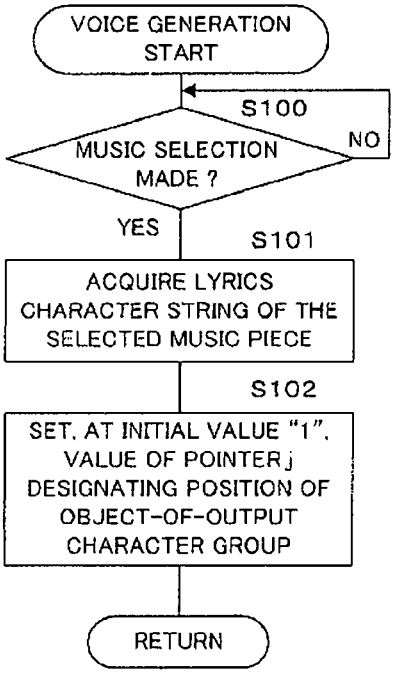
FIG. 3A is a flow chart showing an example of a voice generation start process.
Figure 3C:
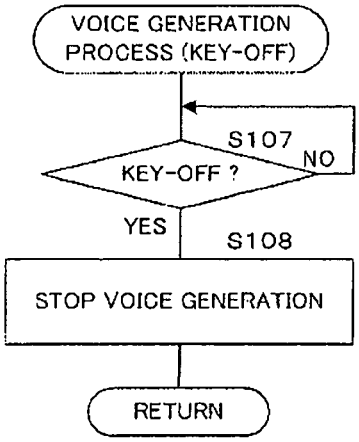
FIG. 3C is a flow chart showing an example of a voice generation process (key-off process).
Figure 3B:
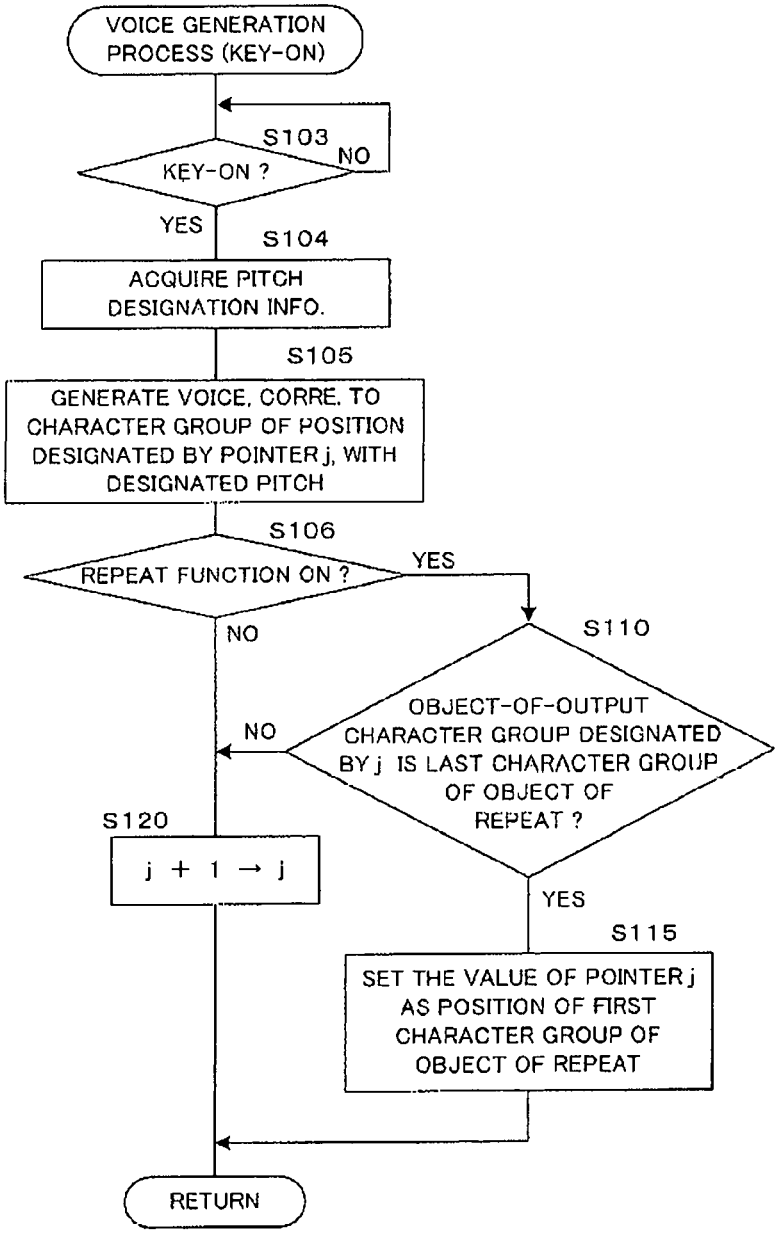
FIG. 3B is a flow chart showing an example of a voice generation process (key-on process).

FIGS. 3A to 3C show a basic example of voice generation processing performed by the CPU 20. FIG. 3A shows an example of a voice generation start process. Once the user operates the input/output section 60 to select a music piece for which voices are to be generated, i.e. which should become an object of voice generation, the CPU 20 determines at step S100 that a music piece selection has been made, and then the CPU 20 proceeds to step S101, where it acquires character information 30*b* of a lyrics character string of the selected music piece from the non-volatile memory 30 and buffers the acquired character information 30*b* into the RAM 40. Note that the character information 30*b* of the lyrics character string of the selected music piece thus buffered into the RAM 40, as noted above, includes character data of individual character groups each comprising one or a plurality of characters, and position data indicative of positions, in the lyrics progression order, of the character groups. Then, at step S102, the CPU 20 sets, at an initial value "1", a value of a pointer j (variable) for designating the position, in the progression order, of any one of the character groups for which a voice is to be output or which is to be voiced (in other words, which should become an object-of-output character group). The pointer j is kept in the RAM 40. A voice (syllable) indicated by the character data of the one character group in the lyrics character string which has the position data corresponding to the value of the pointer j will be generated at the next voice generation time. The "next voice generation time" is when the user next designates a desired pitch on the pitch selector 50. For example, value "1" of the pointer j designates the character group of the first position "1", value "2" of the pointer j designates the character group of the second position "2", and so on.

Further, FIG. 3B shows an example of a voice generation process (key-on process) for generating a voice in accordance with pitch designation information. Once the user depresses or operates the pitch selector 50 to select (designate) a pitch (preferably, a pitch based on a musical score of the selected music piece), the CPU 20 determines at step S103 that a key-on operation has been performed, and then goes to step S104. At step S104, the CPU 20 acquires operating state information (i.e., pitch designation information indicative of the designated pitch and information indicative of a velocity or intensity of the user operation, etc.) on the basis of output information from sensors provided in the pitch selector 50. Then, at step S105, the CPU 20 generates a voice, corresponding to the object-of-output character group designated by the pointer j, with the designated pitch, volume intensity, etc. More specifically, the CPU 20 acquires, from the voice fragment database 30*c*, voice fragment data for reproducing a voice of the syllable indicated by the object-of-output character group. Further, the CPU 20 performs a pitch conversion process on data corresponding to a vowel in the acquired voice fragment data to convert the vowel into vowel voice fragment data having the pitch designated by the user on the pitch selector 50. Further, the CPU 20 replaces the data, corresponding to the vowel in the acquired voice fragment data for reproducing a voice of the syllable indicated by the object-of-output character group, with the vowel voice fragment data having been subjected to the pitch conversion process, and then the CPU 20 performs the inverse FFT on data obtained by combining these voice fragment data. As a consequence, a voice signal for reproducing the voice of the syllable indicated by the object-of-output character group (i.e., a digital voice signal in the time domain) is synthesized.

Note that the aforementioned pitch conversion process may be arranged in any desired manner as long as it can convert a voice of a particular pitch to a voice of another pitch; for example, the pitch conversion process may be implemented by operations for evaluating a difference between the pitch designated on the pitch selector 50 and the reference pitch of the voice indicated by the voice fragment data, shifting, in a frequency axis direction, a spectral distribution indicated by the waveform of the voice fragment data by frequencies corresponding to the evaluated difference, etc. Needless to say, the pitch conversion process may be implemented by various other operations than the aforementioned and may be performed on the time axis. The voice generation of step S105 is arranged to also control the state (e.g., pitch) of the to-be-generated voice in accordance with an operation performed via the voice control operator 60*b*, as will be later described in greater detail. In the voice generation of step S105, various factors (such as pitch, volume and color) of the to-be-generated voice may be made adjustable, and voice control for imparting vibrato and/or the like to the to-be-generated voice may be performed.

Once the voice signal is generated, the CPU 20 outputs the generated voice signal to the sound output section 70. Then, the sound output section 70 converts the voice signal into an analog waveform signal and audibly outputs the analog waveform signal after amplification. Thus, from the sound output section 70 is audibly output the voice that is of the syllable indicated by the object-of-output character group and that has the pitch, volume intensity, etc. designated on the pitch selector 50.

At following step S106, the CPU 20 determines whether the repeat function has been turned on by an operation of the repeat operator 60*c*, details of which will be described later. Normally, the repeat function is in an OFF state, and thus, a NO determination is made at step S106, so that the CPU 20 goes to step S120 where the value of the pointer j is incremented by "1". Thus, an object-of-output character group designated by the incremented value of the pointer j corresponds to a voice to be generated at the next voice generation time.

FIG. 3C shows an example of a voice generation process (key-off process) for stopping generation of a voice generated in accordance with the pitch designation information. At step S107, The CPU 20 determines, on the basis of output information from the sensor provided in the pitch selector 50 whether a key-off operation has been performed, i.e. whether a depression operation on the pitch selector 50 has been terminated. If it has been determined that a key-off operation has been performed, the CPU 20 stops (or attenuates) the currently generated voice to thereby deaden the voice signal currently output from the sound output section 70 (S108). As a consequence, the voice output from the sound output section 70 is terminated. Through the aforementioned processes (key-on and key-off processes) of FIGS. 3B and 3C, the CPU 20 causes the voice of the pitch and intensity designated on the pitch selector 50 to be output for a time period designated on the pitch selector 50.

In the above-described processing, the CPU 20 increments the variable (pointer j) for designating the object-of-output character group, each time the pitch selector 50 is operated once (step S120). In the instant embodiment, the CPU 20, after starting the operation for generating and outputting the voice corresponding to the object-of-output character group with the pitch designated on the pitch selector 50, increments the variable (pointer j) irrespective of whether the generation and output of the voice has been stopped or not. Thus, in the instant embodiment, the term "object-of-output character group" refers to a character group corresponding to a voice to be generated and output in response to the next voice generation instruction, in other words a character group waiting for voice generation and output.

(4) Display of Character for which Voice is to be Generated

In the instant embodiment, the CPU 20 may display, on a display of the input/output section 60, the object-of-output character group and at least another character group of the position, in the progression order, preceding or succeeding the object-of-output character group. For example, a lyrics display frame for displaying a predetermined number of characters (e.g., m characters) is provided on the display of the input/output section 60. The CPU 20 references the RAM 40 to acquire, from the character string, a total of m characters including one character group of the position designated by the pointer j and other characters preceding and/or succeeding the one character group and then displays the thus-acquired characters on the lyrics display frame of the display.

Further, the CPU 20 may cause the input/output section 60 to present a display such that the object-of-output character group and the other characters are visually distinguished from each other. Such a display can be implemented in various manners, such as by highlighting the object-of-output character group (e.g., flashing the object-of-output character group, changing the color of the object-of-output character group, or adding an underline to the object-of-output character group), clearly displaying the other characters preceding or succeeding the object-of-output character group (e.g., flashing the other characters, changing the color of the other characters, or adding an underline to the other characters), and/or the like. Further, the CPU 20 switches the displayed content on the display of the input/output section 60 so that the object-of-output character group is always displayed on the display of the input/output section 60. The display switching may be implemented in various manners, such as by scrolling the displayed content on the display as the object-of-output character group is switched to another in response to a change in the value of the pointer j, sequentially switching the displayed content by a plurality of characters at a time, and/or the like.

(5) Basic Example of Voice Generation Based on Characters

Figure 2A:
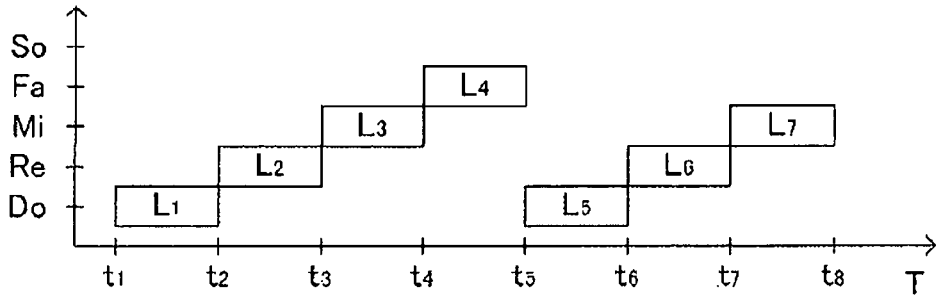
FIG. 2A is a diagram showing an actual example of voice generation based on characters.

FIG. 2A is a diagram showing a basic example of voice generation based on characters. In FIG. 2A, the horizontal axis is the time axis, and the vertical axis is an axis representing pitches. In FIG. 2A, pitches corresponding to several syllable names (Do, Re, Mi, Fa and So) in a musical scale are represented on the vertical axis. Further, in FIG. 2A, character groups of first to seventh positions, in a progression order, of a character string for which voices are to be generated are depicted by reference characters $L_1$, $L_2$, $L_3$, $L_4$, $L_5$, $L_6$ and $L_7$. Further, in the diagram of FIG. 2A, voices to be generated and output are depicted by rectangular blocks, a length, in the horizontal direction (time-axis direction), of each of the rectangular blocks corresponds to an output duration time of the voice, and a position, in the vertical direction, of each of the rectangular blocks corresponds to a pitch of the voice. More specifically, in FIG. 2A, a middle position, in the vertical direction, of each of the rectangular blocks corresponds to the pitch of the voice.

Further, in FIG. 2A, there are shown voices generated and output when the user operates the pitch selector 50 at time points $t_1$, $t_2$, $t_3$, $t_4$, $t_5$, $t_6$ and $t_7$ to designate syllable names Do, Re, Mi, Fa, Do, Re and Mi in the order mentioned. In synchronism with the user operating the pitch selector 50 to designate syllable names Do, Re, Mi, Fa, Do, Re and Mi like this, the object-of-output character group sequentially changes like $L_1$, $L_2$, $L_3$, $L_4$, $L_5$, $L_6$ and $L_7$. Thus, in the illustrated example of FIG. 2A, voices corresponding to the character groups depicted by $L_1$, $L_2$, $L_3$, $L_4$, $L_5$, $L_6$ and $L_7$ are sequentially output with the pitches of Do, Re, Mi, Fa, Do, Re and Mi in synchronism with the user operating the pitch selector 50 to designate syllable names Do, Re, Mi, Fa, Do, Re and Mi.

According to such a basic example of voice generation, the user can control the voice pitch and the character progression via the pitch selector 50, so that singing voices corresponding to the lyrics having a predetermined order of characters can be generated (automatically sung) with pitches exactly as desired by the user. However, in such a basic example, the characters in the character string progress in accordance with the predetermined progression order, and thus, if the user performs an unscheduled operation, such as an erroneous operation, on the pitch selector 50 that differs from, or does not correspond to, an actual progression of the music piece, the progression of the singing voices would undesirably become faster or slower than the progression of the music piece. In the illustrated example of FIG. 6B, for instance, if the user erroneously operates the pitch selector 50 to sequentially designate three pitches of Ti, Do, #Do and #Do in a measure where words "sometimes I" of positions 1, 2 and 3 are to be sung and where the user should sequentially designate three pitches of Ti, Do and #Do, voices of "sometimes I won-" would be erroneously synthesized. Thus, in this case, the first lyrics syllable "won-" in the next measure would be erroneously output at the end of the preceding measure, so that the lyrics progression would thereafter become faster. Although desired pitches can be designated on the pitch selector 50, the lyrics character progression cannot be moved backward or forward via the pitch selector 50.

(6) Specific Example of Character Selector 60*a*

In view of the foregoing, the controller 10*a* of the keyboard musical instrument 10 according to the instant embodiment is provided with a character selector 60*a*, and the controller 10*a* is constructed in such a manner that, even when an unscheduled operation has been performed on the pitch selector 50, the object-of-output character group for which voices are to be generated (i.e., which is to be voiced) can be returned to a character group conforming to the scheduled or original music piece progression by the user operating the character selector 60*a*. Further, an ad-lib performance modifying the original music piece progression can be executed by the user intentionally operating the pitch selector 50 and the character selector 60*a* in combination as necessary.

More specifically, as shown in FIG. 1A, the character selector 60*a* includes a forward character shift selection button Mcf for shifting the object-of-output character group by one character group (by one position) forward in accordance with the progression order of the lyrics character string, and a backward character shift selection button Mcb for shifting the object-of-output character group by one character group (by one position) backward (opposite the forward direction of the progression order). The character selector 60*a* also includes a forward phrase shift selection button Mpf for shifting the object-of-output character group by one phrase forward in accordance with the progression order of the lyrics character string, and a backward phrase shift selection button Mpb for shifting the object-of-output character group by one phrase backward (opposite the forward direction of the progression order). The term "phrase" is used to refer to a series of a plurality of characters, and a plurality of such phrases are pre-defined by boundaries or ends of the individual phrases being described in the character information 30*b* of the lyrics character string. For example, in the character information 30*b*, codes, each of which is indicative of the end of a phrase and may for example be a space-indicating code, are inserted at intermediate positions of the arrangement of the individual character codes in the character string. Thus, the position, in the progression order of the character string, of the leading or first character group of a phrase immediately preceding the current value of the pointer j and the position, in the progression order, of the leading or first character group of a phrase immediately succeeding the current value of the pointer J can be readily identified from the phrase definitions provided in the character information 30*b* of the lyrics character string. Note that the forward character shift selection button Mcf and the forward phrase shift selection button Mpf are each a forward shift selector for shifting the object-of-output character group by one or a plurality of characters forward in accordance with the progression order of the character string while the backward character shift selection button Mcb and the backward phrase shift selection button Mpb are each a backward shift selector for shifting the object-of-output character group by one or a plurality of characters backward, i.e. opposite the forward direction of the progression order of the character string.

(7) Character Selection Process

Figure 3D:
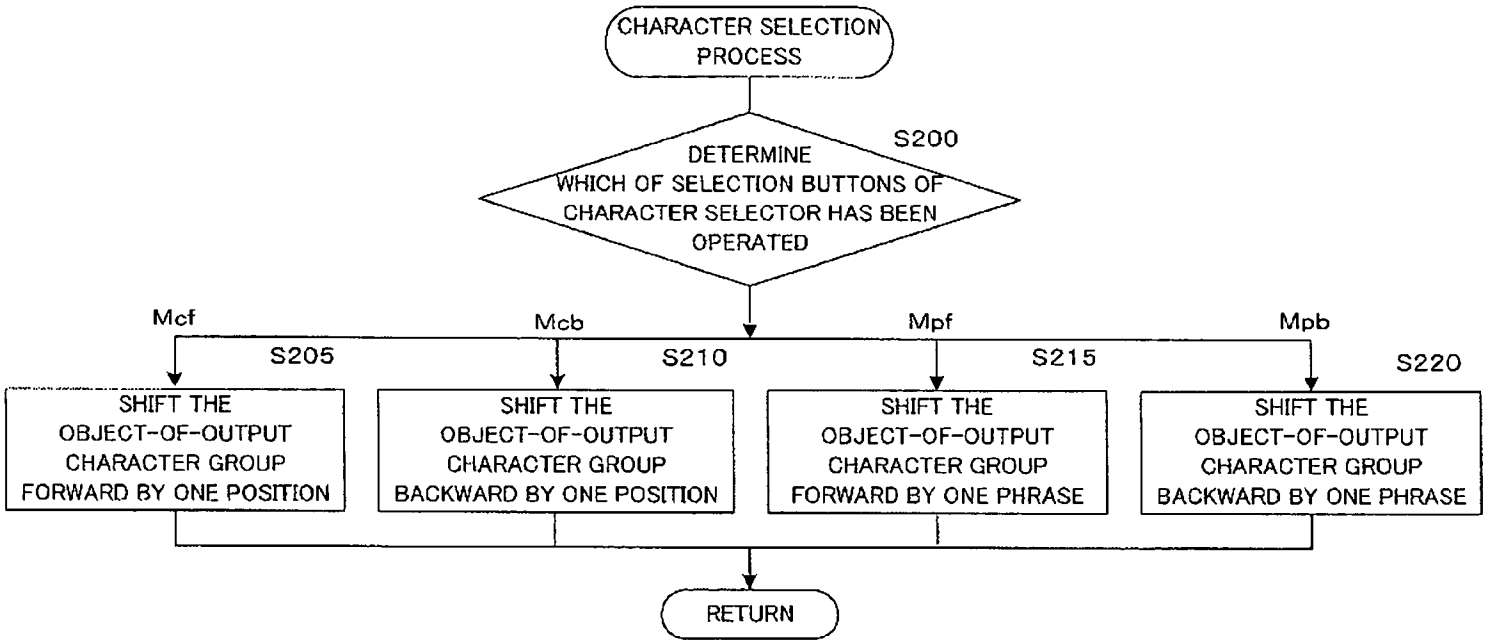
FIG. 3D is a flow chart showing an example of a character selection process.

The following describe, with reference to FIG. 3D, an example of a character selection process performed by the CPU 20 in accordance with the voice generation program 30*a*. The character selection process is started in response to an operation (depression and subsequent termination of the depression) of any one of the selection buttons of the character selector 60*a*. The CPU 20 determines at step S200 which of the selection buttons of the character selector 60*a* has been operated. More specifically, once any one of the forward character shift selection button Mcf, forward character shift selection button Mpf, forward phrase shift selection button Mpf and backward phrase shift selection button Mpb of the character selector 60*a* is operated, signals indicative of a type and content of the operation of the operated selection button are output from the operated selection button. Thus, the CPU 20 determines, on the basis of the output signals, which of the forward character shift selection button Mcf, forward character shift selection button Mpf, forward phrase shift selection button Mpf and backward phrase shift selection button Mpb the operated selection button is.

When the operated selection button is the forward character shift selection button Mcf, the CPU 20 shifts the position, in the progression order, of the object-of-output character group forward by one position (step S205). Namely, the CPU 20 increments the value of the pointer j by one. When the operated selection button is the backward character shift selection button Mcb, the CPU 20 shifts the position of the object-of-output character group backward by one position (step S210). Namely, the CPU 20 decrements the value of the pointer j by one.

Further, when the operated operator is the forward phrase shift selection button Mpf, the CPU 20 shifts the position of the object-of-output character group forward by one phrase (step S215). Namely, the CPU 20 references the character information 30*b* of the lyrics character train to search for the end of a nearest phrase present between the current object-of-output character group and a character group of a position in the progression order succeeding (i.e., greater in position-indicative value than) the current object-of-output character group. Then, when the end of the nearest phrase has been detected, the CPU 20 sets a numerical value indicative of the position of a character group located next to the end of the nearest phrase (i.e., a position, in the progression order, of the leading or first character group of a phrase immediately succeeding the end of the nearest phrase) into the pointer j.

Further, when the operated operator is the backward phrase shift selection button Mpb, the CPU 20 shifts the position of the object-of-output character group backward by one phrase (step S220). Namely, the CPU 20 references the character information 30*b* of the lyrics character train to search for the end of a nearest phrase present between the current object-of-output character group and a character group of a position in the progression order preceding (i.e., smaller in position-indicative value than) the current object-of-output character group. Then, when the end of the nearest phrase has been detected, the CPU 20 sets a numerical value indicative of the position of a character group located backward next to the end of the nearest phrase (i.e., a position, in the progression order, of the leading or first character group of a phrase immediately preceding the end of the nearest phrase) into the pointer j.

Once the user designates a pitch by operating the pitch selector 50 at generally the same time that, or at an appropriate timing immediately after, the value of the pointer j is incremented or decremented as needed in response to a user's operation of the character selector 60*a*, the CPU 20 performs the process of FIG. 3B, where a YES determination is made at step S103. In response to the YES determination at step S103, the operations at and after step S104 are performed so that a voice corresponding to the character group (one or more characters) designated in response to the user's operation of the character selector 60*a* is output. Namely, a voice of the character group of the position shifted forward by one position is generated when the forward character shift selection button Mcf has been operated (step S205); a voice of the character group of the position shifted backward by one position is generated when the backward character shift selection button Mcb has been operated (step S210); a voice of the first character group in the next (immediately succeeding) phrase is generated when the forward phrase shift selection button Mpf has been operated (step S215); and a voice of the first character group in the immediately preceding phrase is generated when the backward phrase shift selection button Mpb has been operated (step S220). In this way, voices of the lyrics characters are generated which have been modified as appropriate or are to be ad-lib performed in response to user's operations of the character selector 60*a*.

(8) Example of Correction of Erroneous Operation

Figure 2B:
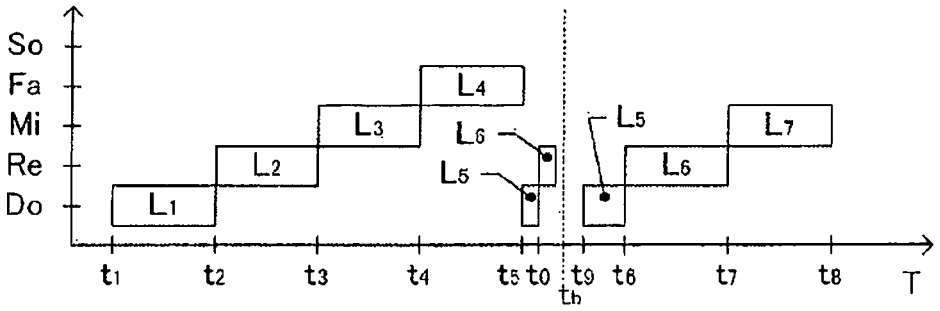
FIG. 2B is a diagram showing an actual example of voice generation based on characters.

The order of the character groups for which voices are to be generated can be modified by a user's operation of the character selector 60*a* as set forth above. Thus, even when the user has performed an erroneous pitch designation operation on the pitch selector 50, the order of the character groups for which voices are to be generated can be adjusted back to an appropriate order corresponding to the predetermined music piece progression. FIG. 2B shows an example where the user has erroneously operated the pitch selector 50 during a performance of a music piece similar to that shown in FIG. 2A, and where such an erroneous operation is corrected. More specifically, FIG. 2B shows a case where, although the user should designates only the pitch of Do for a period from time point $t_5$ to time point $t_6$ by a depression operation of the pitch selector 50, the user first depresses the pitch selector 50 to designate the pitch of Do, then terminates the depression operation of the pitch selector 50 for the pitch of Do immediately after the depression operation (at time point $t_0$) and then depresses the pitch selector 50 to designate the pitch of Re.

According to the instant embodiment, the position of the object-of-output character group changes in synchronism with the user's operations of the pitch selector 50, in such a case. Therefore, as shown in FIG. 2B, generation of a voice corresponding to the character group $L_5$ is started at time point $t_5$, and then, at time point $t_0$, not only the generation of the voice corresponding to the character group $L_5$ is ended, but also generation of a voice corresponding to the character group $L_6$ is started. Thus, in this case, not only the voice of a wrong pitch is output, but also the subsequent lyrics characters would progress inappropriately. However, the instant embodiment is arranged so that that, even in such a case, the position of the object-of-output character group is shifted backward by one position by the user operating the backward character shift selection button Mcb, for example, at time point $t_b$. Thus, if the user operates the pitch selector 50 to designate the pitch of Do at time point $t_9$, the voice corresponding to the right character group $L_5$ is output with the right pitch of Do. In this way, the error in the pitch designation operation on the pitch selector 50 can be corrected appropriately. Further, when, in the illustrated example of FIG. 6B, the user erroneously designates the pitches of Ti, Do, #Do and #Do in the measure where the lyrics words "some-times I" of positions 1, 2 and 3 are to be sung and where the user should sequentially designates the three pitches of Ti, Do and #Do as set forth above, the erroneous operation can be readily corrected so that the right lyrics syllable "won-" starts at the beginning of the next measure, by the user operating the backward character shift selection button Mcb once.

With the aforementioned construction, the user can change the object-of-output character group on a character-group-by-character-group basis or on a phrase-by-phrase basis in accordance with the order indicated by the character information, by operating the character selector 60*a*. Thus, with the simple construction, the user can appropriately correct the object-of-output character group; besides, if the user accurately remember the order of the lyrics character string, the user can also modify the object-of-output character group by a mere touching operation without relying on the sense of vision.

Further, according to the aforementioned construction, a voice corresponding to the object-of-output character group is generated in synchronism with an operation of the pitch selector 50, and then, the pointer j designating the position of the object-of-output character group is incremented. Thus, once the voice is generated in response to the operation of the pitch selector 50, another character group of the position immediately succeeding the character group corresponding to the generated voice becomes the object of output. In this manner, the user can know a state of progression of the singing voices by listening to the voice having been output at the current time point. Thus, when the user operates any one of the buttons of the character selector 60*a*, the user can readily know for which lyrics character a voice can be generated next, i.e. which lyrics character can be voiced next. For example, if the user operates the backward character shift selection button Mcb so that the object-of-output character group is shifted backward by one position, the user can recognize that the character group corresponding to the currently output voice (or last-output voice of voices whose output has been completed) can be made the object-of-output character group again. In this way, the user can change the object-of-output character group by operating the character selector 60*a* on the basis of information acquired through the auditory sense, so that the user can more easily correct the object-of-output character group by a mere touching operation without relying on the sense of vision.

(9) Voice Control Process

Further, the instant embodiment is configured to be capable of controlling a characteristic (e.g., adjusting a pitch) of a voice to be generated in response to the user operating the voice control operator 60*b* in order to enhance the performance of the keyboard musical instrument 10 as a musical instrument. More specifically, once the voice control operator 60*b* is operated with a finger of the user during generation of a voice responsive to an operation of the pitch selector 50, the CPU 20 acquires a touching contact position of the finger on the voice control operator 60*b* and also acquires a correction amount associated in advance with the contact position. Then, the CPU 20 controls a characteristic (any one of pitch, volume, color, etc.) of the currently generated voice in accordance with the correction amount.

Figure 4A:
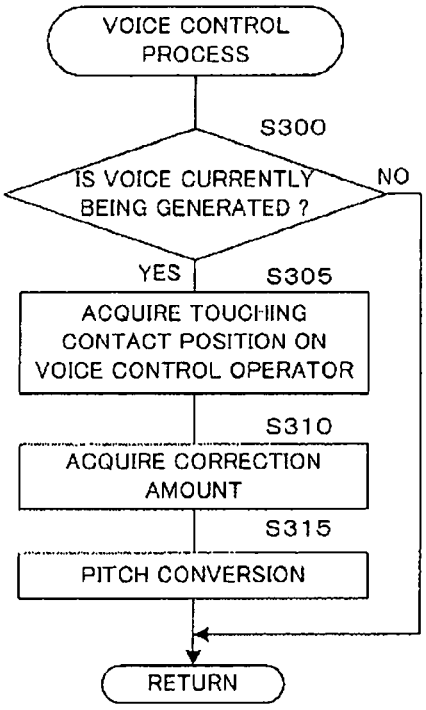
FIG. 4A is a flow chart showing an example of a voice control process.

FIG. 4A shows an example of the voice control process which is performed by the CPU 20 in accordance with the voice generation program 30*a* and in which a pitch is adjusted in response to an operation of the voice control operator 60*b*. This voice control process is started once the voice control operator 60*b* is operated (i.e., once a user's finger contacts the voice control operator 60*b*). In the voice control process, the CPU 20 first determines at step S300 whether any voice is currently being generated. For example, the CPU 20 determines that a voice is currently being generated, for a period from a time when a signal indicating that a pitch-designating depression operation has been performed is output from the pitch selector 50 to a time immediately before a signal indicating the pitch-designating depression operation has been terminated is output. If no voice is currently being generated as determined at step S300, the CPU 20 ends the voice control process, because there is no voice that becomes an object of control.

If a voice is currently being generated as determined at step S300, the CPU 20 acquires a touching contact position of a user's finger (step S305); namely, the CPU 20 acquires a signal indicative of a touching contact position output from the voice control operator 60*b*. Then, on the basis of the contact position of the user's finger on the voice control operator 60*b*, the CPU 20 acquires a correction amount relative to a reference pitch that is the pitch designated on the pitch selector 50.

More specifically, the voice control operator 60*b* is a sensor which has an elongated rectangular finger-contact detecting surface and which is configured to detect at least a one-dimensional operated position (linear position). In one example, a lengthwise middle position of the long side of the voice control operator 60*b* corresponds to the reference pitch, and correction amounts for different touching contact positions are predetermined such that the correction amount of pitch gets greater as the contact position gets farther from the middle position of the long side of the voice control operator 60*b*. Further, of the correction amounts, correction amounts for raising the pitch are associated with individual touching contact positions on one side from the middle position of the voice control operator 60*b*, while correction amounts for lowering the pitch are associated with individual touching contact positions on the other side from the middle position of the voice control operator 60*b*.

Thus, the opposite end positions of the long side of the voice control operator 60*b* represent the highest and lowest pitches. In a construction which permits correction by up to four half tones from the reference pitch, for example, the reference pitch is associated with the middle position of the long side of the voice control operator 60*b*, a pitch higher by four half tones than the reference pitch is associated with one of the opposite ends of the long side, and a pitch higher by two half tones than the reference pitch is associated with a position midway between the one end and the middle position. Further, a pitch lower by four half tones than the reference pitch is associated with the other end of the long side, and a pitch lower by two half tones than the reference pitch is associated with a position midway between the other end and the middle position. In the instant embodiment, where corrected pitches are associated with individual touching contact positions as noted above, the CPU 20, after having acquired a contact-position indicating signal from the voice control operator 60*b*, acquires, as a correction amount, a difference in frequency between the pitch corresponding to the contact position and the reference pitch.

Then, the CPU 20 performs pitch conversion (step S315). Namely, using, as the reference pitch, the pitch designated by the currently depressed pitch selector 50, i.e. the pitch of the voice currently being generated at step S300, the CPU 20 performs pitch adjustment (pitch conversion) of the currently generated voice in accordance with the correction amount acquired at step S310. More specifically, the CPU 20 performs a pitch conversion process for creating voice fragment data with which to output a voice with the corrected pitch, such as by performing a process for shifting, in the frequency axis direction, a spectral distribution indicated by a waveform of voice fragment data with which to output a voice with the reference pitch. Further, the CPU 20 generates a voice signal on the basis of the voice fragment data having been created by the pitch conversion process and outputs the thus-generated tone signal to the sound output section 70. As a consequence, the voice of the corrected pitch is output from the sound output section 70. In the above-described example, an operation of the voice control operator 60*b* is detected during generation of a voice and the correction amount acquisition and the pitch conversion process are performed on the basis of the detected operation as noted above. Alternatively, when the voice control operator 60*b* has been operated before output of a voice is started, followed by an operation of the pitch selector 50, the correction amount acquisition and the pitch conversion process may be performed, during generation of a voice corresponding to the operation of the pitch selector 50, while reflecting the operation of the voice control operator 60*b* immediately preceding the generation of the voice.

(10) Actual Examples of Ad-Lib Singing Performance and Voice Control

Figure 2C:
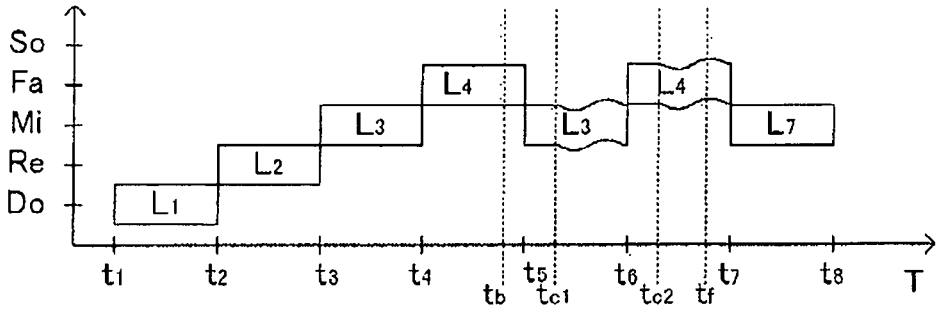
FIG. 2C is a diagram showing an actual example of voice generation based on characters.

FIG. 2C shows an example where an ad-lib performance responsive to an operation of the character selector 60*a* and voice control responsive to an operation of the voice control operator 60*b* are performed in combination during a performance of a music piece similar to that of FIG. 2A. More specifically, FIG. 2C shows an example where an operation (consisting of depression and subsequent termination of the depression) of the backward character shift selection button Mcb of the character selector 60*a* has been performed twice at time point $t_b$. In the illustrated example of FIG. 2C, once the pitch selector 50 is operated at time point $t_4$ to designate the pitch of Fa, a voice corresponding to the character group $L_4$ starts to be generated with the pitch of Fa, but also the object-of-output character group designated by the pointer j switches to the character group $L_5$. Then, at time point $t_b$, the backward character shift selection button Mcb is operated twice in a repeated fashion, in response to which the position of the object-of-output character group is shifted backward by two positions, so that the character group $L_3$ becomes the object-of-output character group.

Thus, once the pitch of Mi is designated by an operation on the pitch selector 50 at next time point $t_5$, a voice corresponding to the character group $L_3$ is generated with the pitch of Mi. In this case, once the generation of the voice corresponding to the character group $L_3$ is started, the object-of-output character group designated by the pointer j switches to the next character group $L_4$. The generation of the voice corresponding to the character group $L_3$ lasts from the start time of the depression operation of the pitch selector 50 designating the pitch of Mi (i.e., from time point $t_5$) to a time at which the depression operation of the pitch selector 50 is terminated (i.e., to time point $t_6$). Then, once the pitch of Fa is designated by an operation of the pitch selector 50 at time point $t_6$, a voice corresponding to the object-of-output character group $L_4$ is generated with the pitch of Fa.

In the illustrated example of FIG. 2C, the voices indicated by the character groups $L_3$ and $L_4$ are output with the pitches of Mi and Fa in a period from time point $t_5$ to time point $t_7$, although the voices indicated by the character groups $L_5$ and $L_6$ should be output with the pitches of Do and Re in the period from time point $t_5$ to time point $t_7$ when the performance is to be executed exactly in accordance with the structure of the music piece. These character groups and pitches are identical to the character groups and pitches at immediately preceding time points $t_3$ to $t_5$, which means that the same lyrics characters and pitches as at time points $t_3$ to $t_5$ are repeated at time points $t_5$ and $t_7$. Such an example of performance is used, for example, when the performance warms up or rises to a climax, such as in a case where a portion where the voices indicated by the character groups $L_3$ and $L_4$ are output with the pitches of Mi and Fa is a highlighted or climaxing portion of the music piece and where a chorus repeating same content is inserted following the main vocal singing. In this way, it is possible to execute an ad-lib singing performance as appropriate.

Further, in such a case, although the same lyrics characters are repeated as noted above, a perfection level of the performance can often be enhanced if the singing voices repeated in the period from time point is to time point $t_7$ are different in state than the singing voices output in the period from time point $t_3$ to time point $t_5$. Further, in the instant embodiment, where the keyboard 10 is provided with the voice control operator 60*b*, the user can change, by operating the voice control operator 60*b*, the state of the singing voices between the first and second of the repeated performances.

Further, in the illustrated example of FIG. 2C, vibrato is performed for varying up and down the pitch in the period from time point $t_5$ to time point $t_7$ where the repeated performance is being executed. Namely, in a period from time point $t_{c1}$ to time point $t_6$ and in a period time point $t_{c2}$ to time point $t_7$, the user, with its finger contacting the character control operator 60*b*, has moved the finger touching contact position left and right in FIG. 1A across the lengthwise middle position of the character control operator 60*b*. In this case, the voice indicated by the character group $L_3$ varies up and down across the pitch of Mi, and the voice indicated by the character group $L_4$ varies up and down across the pitch of Fa. Thus, the user can perform a voice of a same lyrics portion in a manner of control differing between the first and second of the repeated performances. In this way, the user can not only execute modification of the lyrics and voice control in a flexible fashion but also perform a same lyrics portion a plurality of times with different intonations. As a result, it is possible to increase the range of expressions of character-based voices.

Further, in the illustrated example of FIG. 2C, it is necessary for the user to operate the forward character shift selection button Mcf, in order to return the progressing position of the lyrics characters to the original predetermined progressing position (in order to set the character group to be voiced at time point $t_7$ at the character group $L_7$) once the repeated lyrics portion played as an ad-lib performance is completed. FIG. 2C shows an example where the user has performed operations of the forward character shift selection button Mcf (i.e., depression operation and depression termination operation) twice at time point $t_f$. Namely, because the object-of-output character group has been set at the character group $L_5$ by a user's operation of the pitch selector 50 at time point $t_6$, the object-of-output character group is switched to the character group $L_7$ in response to the user operating the pitch selector 50 twice at time point $t_f$. Thus, by the user operating the pitch selector 50 to designate the pitch of Mi at time point $t_7$, the voice indicated by the character group $L_7$ is output with the pitch of Mi, so that the music piece in question can be caused to progress upon returning back to the original order of the lyrics character and original pitch.

Note that, although it is necessary for the user to simultaneously operate the forward character shift selection button Mcf and the voice control operator 60*b* at time point $t_f$, the user can easily perform such simultaneous operations of the selection button Mcf and the control operator 60*b* by use of the controller 10*a* according to the embodiment of the invention. Namely, with the controller 10*a* according to the embodiment of the invention, where the voice control operator 60*b* is provided on the front flat surface of the grip as viewed from the user and the forward character shift selection button Mcf is provided between the upper and rear flat surfaces of the grip, the user can operate the forward character shift selection button Mcf with the thumb of one hand and operate the voice control operator 60*b* with another finger (such as the index finger) while holding the grip G with the one hand; thus, the user can simultaneously operate the forward character shift selection button Mcf and the voice control operator 60*b*.

Figure 2D:
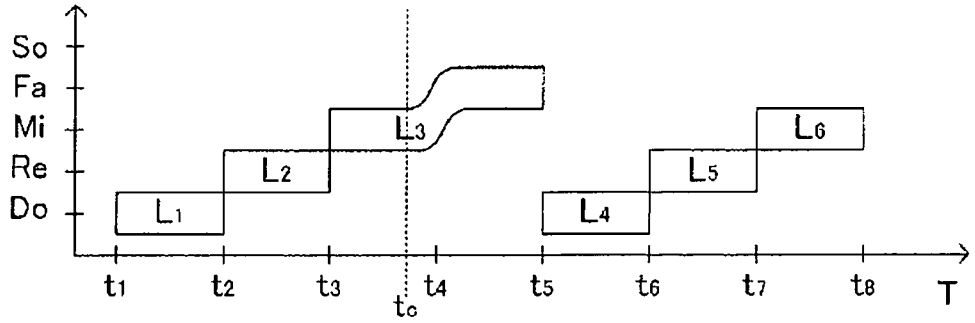
FIG. 2D is a diagram showing an actual example of voice generation based on characters.

With the voice control operator 60*b* provided in the aforementioned manner, it is possible to execute singing voice performances in many variations. For example, even with the construction where the order of character groups is caused to progress each time the single pitch selector 50 is operated once, a voice indicated by a single character group can be generated with two or more successive pitches. Let' assume, for example, a song to be performed sequentially in the order of the character groups $L_1$, $L_2$, $L_3$, $L_4$, $L_5$ and $L_6$ and with predetermined pitches, i.e., Do for the character group $L_1$, Re for the character group $L_2$, Mi and Fa for the character group $L_3$, Do for the character group $L_4$, Re for the character group $L_5$, and Mi for the character group $L_1$. In this case, the user operates the pitch selector 50 to designate the pitches of Do, Re and Mi at time points $t_1$, $t_2$ and $t_3$, respectively, as shown in FIG. 2D and operates the voice control operator 60*b* at time point $t_c$ to raise the reference pitch of Mi by a half step, i.e. up to the pitch of Fa. As a consequence, the voice indicated by the character group $L_1$ is generated with the pitch of Do, the voice indicated by the character group $L_2$ is generated with the pitch of Re, and the voice indicated by the character group $L_3$ is generated with the pitch of Mi and then with the pitch of Fa. After that, by the user operating the pitch selector 50 to designate the pitches of Do, Re and Mi at time points $t_5$, $t_6$ and $t_7$, respectively, the voice indicated by the character group $L_4$ is output with the pitch of Do, the voice indicated by the character group $L_5$ is output with the pitch of Re, and the voice indicated by the character group $L_6$ is output with the pitch of Mi. Thus, according to the instant embodiment, the user can cause a voice indicated by a single character group to be output with two or more successive pitches. Note that, in the above-described construction, the pitch variation from Mi to Fa is effected continuously in accordance with to a speed at which the user operates the voice control operator 60*b*. Thus, a voice closer to a human singing voice can be generated.

With the above-described construction, the user can use the controller 10*a* to give an instruction for generating voices based on characters in various expressions. Further, while the user is performing the keyboard musical instrument 10 and voices are being output in response to the performance of the keyboard musical instrument 10, the user can flexibly execute modification of the lyrics and control of the manner of voice generation, such as repetition of a desired lyrics portion, like a chorus or highlighted portion, and change of intonation in response to warming-up or climaxing of the music piece. Furthermore, when a same lyrics portion is repeated through modification of the lyrics, it is also possible to change the intonation of the same lyrics portion by controlling the manner of voice generation, and thus, it is possible to increase the range of expressions of character-based voices.

(11) Repeat Function

Further, in order to allow an ad-lib performance of the lyrics to be executed in a variety of ways, the instant embodiment of the invention is constructed in such a manner that the user can designate, by operating the repeat operator 60*c*, a range of character groups (character group range) to be set as an object of repeat (i.e., start and end of the repeat performance). More specifically, once the user depresses the repeat operator 60*c*, the CPU 20 starts selection of character groups to be set as an object of repeat. Then, once the user terminates the depression operation on the repeat operator 60*c*, the CPU ends the selection of character groups as the object of repeat. In this manner, the CPU 20 sets, as the object of repeat, the range of the character groups selected while the user was depressing the repeat operator 60*c*.

Figure 2E:
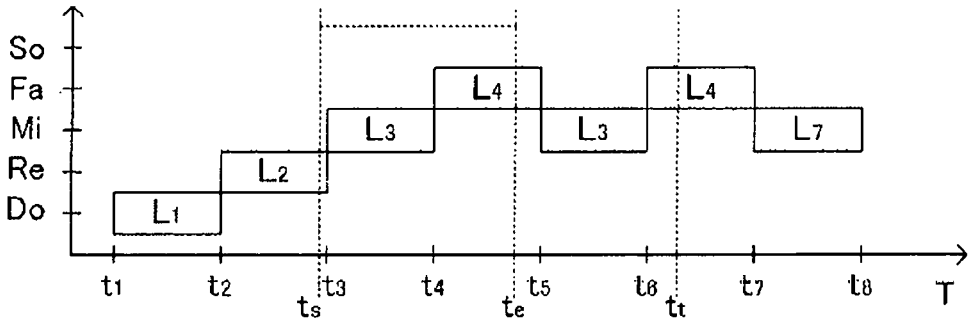
FIG. 2E is a diagram showing an actual example of voice generation based on characters.
Figure 4B:
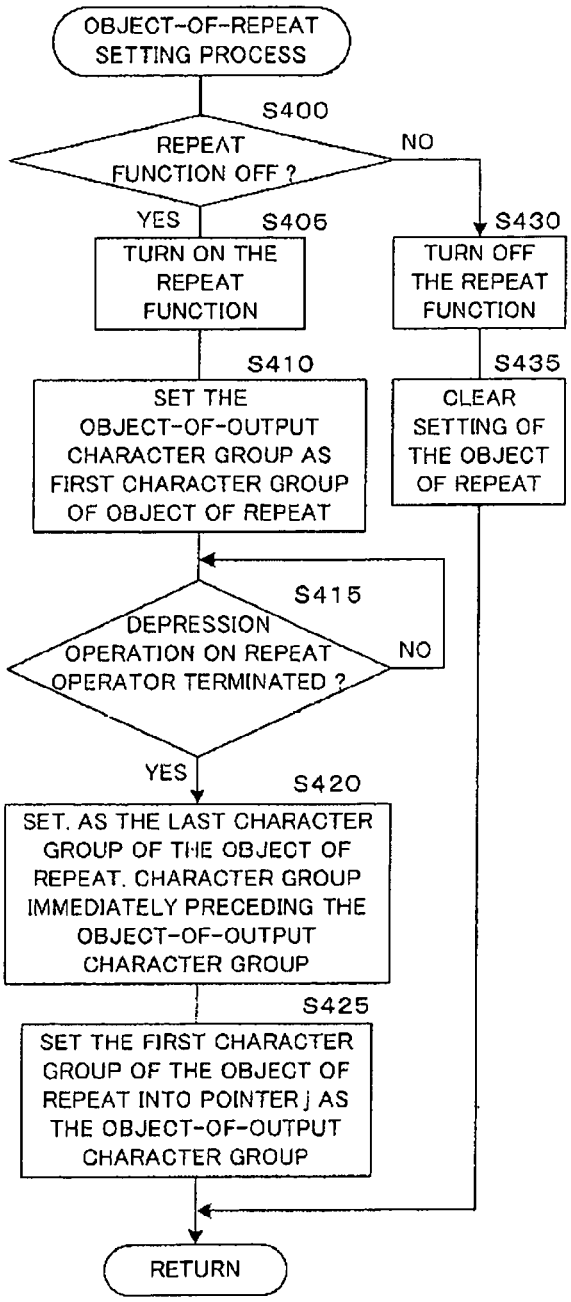
FIG. 4B is a flow chart showing an example of an object-of-repeat selection process.

First, with reference to FIG. 4B, a description will be given about an example of a process for selecting an object of repeat. This object-of-repeat selection process shown in FIG. 4B is performed in response to a depression operation on the repeat operator 60*c*. FIG. 2E shows a case where characters to be made an object of repeat is set during a performance of a music piece similar to that shown in FIG. 2A and where the thus-set object-of-repeat characters are played in a repeated fashion. More specifically, in FIG. 2E, a depression operation is performed on the repeat operator 60*c* at time point $t_s$, the depression operation on the repeat operator 60*c* is terminated at time point $t_e$, and then a depression operation is performed on the repeat operator 60*c* at time point $t_r$.

The following describe the object-of-repeat selection (setting) process with reference to FIG. 2E. In the illustrated example of FIG. 2E, the object-of-repeat selection process is started (triggered) by the depression operation performed on the repeat operator 60*c* at time point $t_s$. In the object-of-repeat selection process, the CPU 20 first determines whether or not the repeat function is currently OFF (step S400). Namely, the CPU 20 determines whether or not the repeat function is currently OFF, with reference to a repeat flag recorded in the RAM 40.

If the repeat function is currently OFF as determined at step S400, the CPU 20 turns on the repeat function (step S405). Namely, in the instant embodiment, once the user depresses the repeat operator 60*c* when the repeat function is OFF, the CPU 20 determines that the repeat function has been switched to the ON state and rewrites the repeat flag recorded in the RAM 40 into a value indicating that the repeat function is currently ON. After the repeat function has been turned on as above, the CPU 20 performs a process for setting a range of character groups (character group range) to be made an object of repeat for a period till the depression operation on the repeat operator 60*c* is terminated.

Then, the CPU 20 sets the object-of-output character group as the first character group of the object of repeat (step S410). Namely, the CPU 20 acquires the current value of the pointer j and records the thus-acquired current value of the pointer j into the RAM 40 as a value indicative of a position, in the progression order, of the first character group of the object of repeat. The object-of-output character group indicated by the current value of the pointer j is indicative of a voice to be generated at the next voice generation time (i.e., the next time the pitch selector 50 is operated). In the illustrated example of FIG. 2E, the generation of the voice corresponding to the character group $L_2$ is started but also the object-of-output character group is updated to the character group $L_3$ in response to the operation on the pitch selector 50 at time point $t_2$. Thus, by step S410 being performed in response to the depression operation on the repeat operator 60*c* at time point $t_s$, the object-of-output character group $L_3$ indicated by the pointer j is set as the first character group of the object of repeat.

Then, the CPU 20 waits until it is determined that the depression operation on the repeat operator 60*c* has been terminated (step S415). Even during the waiting period, the CPU 20 performs the aforementioned voice generation process in response to an operation on the pitch selector 50 (see FIGS. 3B and 3C). Thus, once the pitch selector 50 is operated, the object-of-output character progresses in synchronism with such an operation and in accordance with the order indicated by the character information 30*b*. Once the pitch selector 50 is operated at time points $t_3$ and $t_4$ following time point $t_s$, for example, the object-of-output character group switches to the character groups $L_4$ and $L_5$.

Once the depression operation on the repeat operator 60*c* is terminated as determined at step S415, the CPU 20 sets, as the last character group of the object of repeat, the character group immediately preceding the object-of-output character group (step S420). Namely, the CPU 20 acquires the current value of the pointer j and records a value (j−1) obtained by subtracting 1 (one) from the current value of the pointer j into the Ram 40 as a value indicative of the position of the last character group of the object of repeat. The character group immediately preceding the object-of-output character group, indicated by the value (j−1), corresponds to the currently-generated voice or last-generated voice.

In the illustrated example of FIG. 2E, for instance, generation of the voice corresponding to the character group $L_4$ is started but also the object-of-output character group is updated to the character group $L_5$, in response to the operation on the pitch selector 50 at time point $t_4$. Thus, by step S420 being performed in response to termination of the depression operation on the repeat operator 60*c* at time point $t_c$, the character group $L_4$ indicative of the currently generated voice is set as the last character group of the object of repeat. Thus, in the illustrated example of FIG. 2E, the first character group of the object of repeat is the character group $L_3$ while the last character group of the object of repeat is the character group $L_4$, so that the object of repeat is set to the range of the character groups $L_3$ and $L_4$. In response to the character group range, consisting of the character groups $L_3$ and $L_4$, being set as the object of repeat in the aforementioned manner, voices of the character group range set as the object of repeat can be repeated once or a plurality of times until the repeat function is turned off. Thus, the voices of the character group range set as the object of repeat can be repeated a user-desired number of times. In this way, the instant embodiment permits not only a performance where the voices of the character group range set as the object of repeat are repeated once (same lyrics portion is repeated twice), but also a performance where a particular phrase is repeated many times in response to excitement of the audience as in a live performance.

Once the character group range is set as the object of repeat in the aforementioned manner, the CPU 20 sets the first character group of the object of repeat as the object-of-output character group (step S425). Namely, the CPU 20 references the RAM 40 to acquire a value indicative of the position, in the progression order, of the first character group of the object of repeat and sets the thus-acquired value into the pointer j. Thus, the next time pitch designation information is acquired in response to an operation on the pitch selector 50, a voice corresponding to the first character group of the object of repeat will be generated.

The following describe, with reference to FIG. 3B, an example of a process for repeatedly generating voices of a character group range as an object of repeat selected in the aforementioned manner. Once a pitch designation operation is performed on the pitch selector 50 after the operation of step S425 has been performed, the CPU 20 goes from a YES determination at step S103 of FIG. 3B to step S104, where it acquires pitch designation information indicative of the designated pitch. Then, at step S105, a voice corresponding to the character group of the position designated by the pointer j (i.e., first character group of the object of repeat) is generated with the designated pitch. Then, at step S106, the CPU 20 determines whether the repeat function is currently ON. Because the repeat function is already ON in this case, a YES determination is made at step S106, so that the CPU 20 proceeds to step S110.

At step S110, the CPU 20 determines whether or not the object-of-output character group indicated by the pointer j is the last character group of the object of repeat. If the object-of-output character group indicated by the pointer j is not the last character group of the object of repeat, the CPU 20 branches from a NO determination of step S110 to step S120, where it increments the value of the pointer j by one.

Namely, each time a pitch designation operation is performed on the pitch selector 50, the process of FIG. 3B is performed such that the operations of the route from the NO determination of step S110 to step S120 are repeated until the last character group of the object of repeat is reached. Once the last character group of the object of repeat is reached, a YES determination is made at step S110, so that the CPU 20 goes to step S115. At step S115, the value of the pointer j is set as the position of the first character group of the object of repeat. Then, once a pitch designation operation is performed on the pitch selector 50, the voice corresponding to the first character group of the object of repeat is generated again through the operation of step S105. In this manner, the voices from the first to last character groups of the object of repeat are sequentially generated each time a pitch designation operation is performed, and then, the repeat voice generation is repeated after returning back to the first character group. Such a repeat voice generation process is repeated as along as the repeat function is kept on.

To turn off the repeat function currently in the ON state, the user depresses the repeat operator 60*c* again, in response to which the process of FIG. 4B is performed. Namely, because the repeat function is currently ON, a NO determination is made at step S400, so that the CPU 20 branches to step S430, where the CPU 20 turns off the repeat function. Namely, once the user depresses the repeat operator 60*c* when the repeat function is ON, the CPU 20 considers that the repeat function has been turned off and rewrites the repeat flag recorded in the RAM 40 into a value indicating that the repeat function is OFF.

Then, the CPU 20 clears the setting of the character group range as the object of repeat (step S435). Namely, the CPU 20 deletes, from the RAM 40, the values indicative of the respective positions, in the progression order, of the first and last character groups of the object of repeat. As an example, the CPU 20 is configured to leave the value of the pointer j, i.e. the object-of-output character group, unchanged even when the repeat function has been turned off. Thus, in the illustrated example of FIG. 2E, for instance, when the repeat function has been turned off in response to a depression operation performed on the repeat operator 60*c* at time point $t_1$, the object-of-output character group is left unchanged from the character group $L_5$.

The user can identify the object-of-output character group ($L_5$ in the illustrated example of FIG. 2E) by listening to the voice being output when the user depresses the repeat operator 60*c*, and thus, the user can set a desired character group as the object-of-output character group by operating the character selector 60*a* during a period prior to the next voice generation timing.

For example, the user can set the character group $L_7$ as the object of output by depressing the forward character shift selection button Mcf twice at a timing preceding time point $t_7$. In this case, if the user operates the pitch selector 50 at time point $t_7$, the voice indicated by the character group $L_7$ is output. Further, in a case where a boundary between the character group $L_6$ and the character group $L_7$ is set as the end of a phrase in the character information 30*a*, the user can set the character group $L_7$ as the object of output by depressing the forward character shift selection button Mcf once at a timing preceding time point $t_7$. In such a case too, if the user operates the pitch selector 50 at time point $t_7$, the voice indicated by the character group $L_7$ is output.

Note that, as a modification of the operation of step S435, the CPU 20 may automatically advance the value of the value of the pointer j to an original predetermined progressing position. More specifically, the CPU 20 may sequentially advance a reference pointer, which assumes that no repeat is being made during a repeat performance, in response to a pitch designation operation. For instance, in the illustrated example of FIG. 2E, when the operation of step S435 has been performed in response to a depression operation performed on the repeat operator 60*c* (repeat turning-off operation) at time point $t_r$, the CPU 20 identifies, from the reference pointer, that the object-of-output character group that should be designated by the pointer j is the character group $L_7$. Various other techniques than the aforementioned technique based on the reference pointer may be employed for automatically advancing the value of the value of the pointer j to an original predetermined progressing position in response to turning off of the repeat function. For example, the CPU 20 may count the number of operations performed on the pitch selector 50 while the repeat function is ON and then correct the value of the pointer j at the end of the repeat using the counted number of operations and the value of the pointer j at the start of the repeat.

Figure 2F:
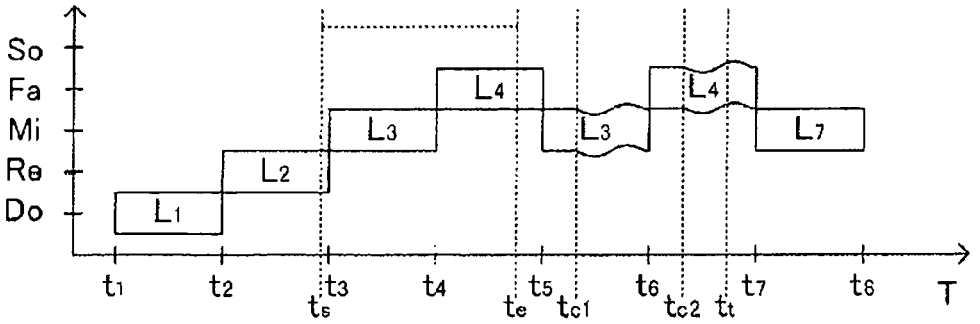
FIG. 2F is a diagram showing an actual example of voice generation based on characters.

Note that combining operations via the repeat operator 60*c* and voice control via the voice control operator 60*b* permits a wide variety of performances. For example, such a combination permits a performance similar to that shown in FIG. 2C, without using the character selector 60*a*. FIG. 2F is a diagram showing an example where a performance similar to that shown in FIG. 2C is executed using the repeat operator 60*c* and the voice control operator 60*b*. More specifically, FIG. 2F shows an example where a depression operation on the repeat operator 60*c* is performed at time point $t_s$, an operation for terminating the depression operation on the repeat operator 60*c* is performed at time point $t_c$, vibrato is imparted for a period from time point $t_{c1}$ to $t_6$ and a period from time point $t_{c2}$ to $t_7$, and a depression operation on the repeat operator 60*c* is performed at time point $t_t$. In response to such operations, the character groups $L_3$ and $L_4$ are performed repeatedly twice in a similar manner to FIG. 2C, of which the second performance is executed with the vibrato imparted thereto.

According to the above-described construction of the instant embodiment, the CPU 20 repeatedly generates, in response to operations on the repeat operator 60*c*, voices corresponding to a character group range set as an object of repeat set as desired by the user. Further, with the instant embodiment, a repeat timing of voices indicated by characters of the object of repeat can be controlled in accordance with a user's instruction (user's operation on the pitch selector 50). Further, the user can designate a desired character range of the lyrics character string and thereby cause voices of the desired character range to be output repeatedly as set forth above, and thus, when a performance of a same portion is to be repeated for mastering, memorizing, etc. of a musical instrument performance, the user can easily designate a desired repeat range and cause the designated repeat range to be performed in a repeated fashion. Besides, the above-described repeat function can be used for mastering etc. of, for example, a foreign language without being limited to a musical instrument performance; as an example, voices of a desired character range can be repeatedly generated, such as for listening training of a foreign language or the like. Furthermore, in creation of the character information 30*b*, creation of a same character group for a repeated performance (i.e., creation of the same character group for being performed for the second or subsequent time following the first performance) may be omitted. In this way, it is possible to simplify the operation for creating the character information 30*b* and hence reduce a necessary storage capacity for the character information 30*b*. Moreover, according to the instant embodiment, a desired portion can be selected from a character string of a predetermined progression order defined as the character information 30*b* and can be repeated while voices are being generated by the voice generation apparatus on the basis of the character information 30*b*, as set forth above. Thus, it is possible to generate voices of the character string with the existing progression order of the character string modified as desired. The existing progression order of the character string may be modified in various manners, such as by trolling, repeating a highlighted or climaxing portion (i.e., chorus) of the music piece, scatting words like "La, La, La", and repeating a portion of a high performing difficulty for a practicing purpose. Further, with the instant embodiment, it is possible to not only designate a character range as an object of repeat but also instruct a start and end of a repeat performance, via the repeat operator 60*c* in the form of a single push button switch. Thus, not only designation of a character range as an object of repeat but also timing control of a repeat performance can be executed with extremely simple operations. Furthermore, repeat-related control can be performed with a reduced number of operations. Moreover, the user can select characters as an object of repeat in real time by listening to voices sequentially output from the sound output section 70; thus, the user can select such characters as an object of repeat without relying on the visual sense.

(12) Other Embodiments

Figure 5:
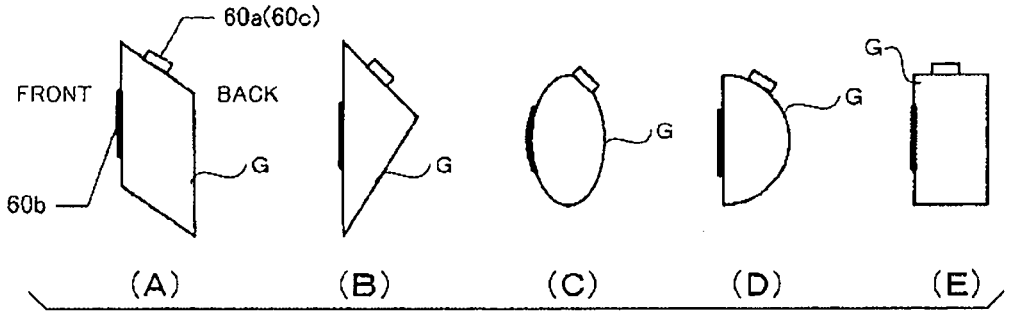
FIG. 5 is a view showing a modification of the shape of the grip of the controller.

The above-described embodiment is just an illustrative example for describing the present invention, and various other embodiments may be employed. For example, the controller 10*a* is not limited to the shape shown in FIG. 1A. (A) to (E) of FIG. 5 are views showing various shapes of the grip G taken from one end of the grip G. As shown in these views, the section of the grip G may be of a polygonal shape (e.g., a parallelogram shown in (A) of FIG. 5, a triangle shown in (B) of FIG. 5, or a rectangle shown in (E) of FIG. 5), a closed curved shape (e.g., an elliptical shape shown in (C) of FIG. 5), or a shape comprising a straight line and a curved line (e.g., a semicircular shape shown in (U) of FIG. 5). Needless to say, the sectional shape and size of the grip G need not necessarily be constant at every sectioned position, and the grip G may be configured to vary in sectional area and curvature in a direction toward the body 10*b*.

Furthermore, for the grip G, it is only necessary that the character selector 60*a*, the repeat operator 60*c* and the voice control operator 60*b* be provided at such positions that, when the character selector 60*a* or the repeat operator 60*c* is operated with a finger of the user, the voice control operator 60*b* can be operated with another finger of the user. For that purpose, the character selector 60*a* (or the repeat operator 60*c*) and the voice control operator 60*b* may be provided on a portion of the grip G where the fingers of one hand of the user are placed while the user is holding the grip G with the one hand. For example, the grip G may be constructed in such a manner that the character selector 60*a* (or the repeat operator 60*c*) and the voice control operator 60*b* are provided on different surfaces rather than on a same flat surface, as shown in (A), (B), (D) and (E) of FIG. 5. Such arrangements can prevent erroneous operations on the character selector 60*a* (or the repeat operator 60*c*) and the voice control operator 60*b* and allows the user to easily simultaneously operate these operators.

Further, in order for the user to stably hold the grip while grasping the grip with one hand, it is preferable that the character selector 60*a* (or the repeat operator 60*c*) and the voice control operator 60*b* not be located on two opposite surfaces (e.g., front and rear surfaces in (A) and (E) of FIG. 5) with the center of gravity of the grip G therebetween. Such arrangements can prevent the user from erroneously operating the character selector 60*a* (or the repeat operator 60*c*) and the voice control operator 60*b* as he or she grasps the grip G.

What is more, the manner of interconnection the controller 10*a* and the body 10*b* is not necessarily limited to that shown in FIG. 1A. For example, the controller 10*a* and the body 10*b* need not necessarily be interconnected at only one position, and the controller 10*a* may be constructed, for example, of a bent columnar member of a U shape and connected at opposite ends of the columnar member to the body 10*b* with a portion of the columnar member formed as the grip. Further, the controller 10*a* may be detachably attachable to the keyboard 10, in which case operation output from the operators of the controller 10*a* is transmitted to the CPU 20 of the body 10*b* through wired or wireless communication.

Furthermore, the application of the present invention is not necessarily limited to the keyboard musical instrument 10 and may be another type of electronic musical instrument equipped with the pitch selector 50. The present invention is also applicable to a singing voice generation device which automatically generates voices of lyrics defined in the character information 30*b* in accordance with pre-created pitch information (such as MIDI information), or an apparatus which reproduces recorded sound information and recorded image information. In such a case, the CPU 20 may acquire pitch designation information (MIDI event information etc.) automatically reproduced in accordance with an automatic performance sequence, generate a voice of a character group, designated by the pointer j, with a pitch designated by the acquired pitch designation information (MIDI event information etc.), and advance the value of the pointer j in accordance with the acquired pitch designation information (MIDI event information etc.). When the pitch selector 60*a* has been operated in the embodiment which acquires such pitch designation information according to the automatic performance sequence, the CPU 20 may temporarily stop acquisition of the pitch designation information according to the automatic performance sequence, acquires, instead of such pitch designation information, pitch designation information given from the pitch selector 50 in response to a user's operation, and then generate a voice of a character group, designated by the pointer j having been changed in response to the operation on the character selector 60*a*, with a pitch designated by the pitch designation information acquired from the pitch selector 50. A modification of the embodiment where the pitch designation information is acquired in accordance with the automatic performance sequence may be constructed in such a manner that, when the pitch selector 60*a* has been operated, the progression of the automatic performance is changed (advanced or returned) in accordance with a change of the value of the pointer j responsive to the operation on the character selector 60*a*, and that pitch designation information automatically generated in accordance with the thus-changed progression of the automatic performance is acquired and then a voice of a character group, designated by the pointer j having been changed in response to the operation of the character selector 60*a*, is generated with a pitch indicated by the acquired pitch designation information. In such a modification, the pitch selector 50 is unnecessary. Even where a voice generation (output) timing is designated by a user's operation, a means for designating such a voice generation (output) timing is not necessarily limited to the pitch selector 50 and may be another type of suitable switch or the like. For example, the modification may be constructed such that information indicative of a pitch of a voice to be generated is acquired from automatic sequence data and a generation timing of that voice is designated in accordance with a user's operation of a suitable switch.

Furthermore, the construction for varying the pitch on the basis of the voice control operator 60*b* is not necessarily limited to the one employed in the above-described embodiment, and various other constructions may be employed. For example, the CPU 20 may be configured to acquire a pitch variation rate from the reference pitch on the basis of a touching contact position on the pitch control operator 60*b* and vary the pitch on the basis of the acquired pitch variation rate. Further, the CPU 20 may consider that a position of the voice control operator 60*b* the user has first contacted the operator 60*b* is the reference pitch while a voice is being generated with the reference pitch, and then, when the contact position has changed from the first contact position, the CPU 20 may determine a pitch correction amount and a pitch variation rate on the basis of a distance between the first contact position and the changed contact position.

In the aforementioned case, a pitch correction amount and pitch variation rate per unit distance are determined in advance. Under such conditions, the CPU 20 acquires a changed distance that is a distance of the changed contact position from the first contact position. Then, the CPU 20 identifies a pitch variation amount and pitch variation rate by multiplying a value, calculated by dividing the changed distance by the unit distance, by the per-unit-distance pitch correction amount and pitch variation rate. Alternatively, the CPU 20 may be configured to identify a pitch correction amount and pitch variation rate on the basis of a change in the contact position on the voice control operator 60*b* (such as a moving velocity) rather than on the basis of a touching contact position on the voice control operator 60*b*. Of course, the width or range over which the pitch is variable via the voice control operator 60*b* is not necessarily limited to the aforementioned and may be any of various other ranges (such as a range of one octave). Further, the pitch variation range may be made variable in accordance with a user's instruction or the like. Furthermore, the object of control by the voice control operator 60*b* may be selected from among pitch, volume, characters of a voice (such as a sex of a voice utterer and characteristic of the voice) in accordance with a user's instruction or the like.

Note that the voice control operator 60*b* may be disposed separate from the grip G having the character selector 60*a* provided thereon, rather than on the grip G. For example, an existing tone control operator provided on the input/output section 60 of the body 10*h* of the keyboard musical instrument 10 may be used as the voice control operator 60*b*.

Furthermore, the way of acquiring the character information 30*b* is not necessarily limited to the aforementioned, and the character information 30*b* may be input from an external recording medium, having the character information 30*b* recorded therein, to the keyboard musical instrument 10 through wired or wireless communication. Alternatively, singing voices being uttered may be picked up in real time via a microphone and buffered into the RAM 14 of the keyboard musical instrument 10 so that character information 30*b* can be acquired on the basis of buffered audio waveform data.

Furthermore, the character information 30*b* defining a predetermined character string of lyrics or the like may be any information as long as it is capable of substantively defining a plurality of characters and an order of the characters, and the character information 30*b* may be in any form of data expression, such as text data, image data or audio data. For example, the character information 30*b* may be expressed with code information indicative of time-serial variation of syllables corresponding to characters, or with time-serial audio waveform data. In shorthand, whatever form of data expression the character information 30*b* may be in, it is only necessary that the character information 30*b* be coded in such a manner that individual character groups (each comprising one or more characters corresponding to a syllable) in the character string are separately distinguishable, and that voice signals can be generated in accordance with such codes.

Furthermore, the above-described voice generation device may be constructed in any desired manner as long as it has a function for generating voices, indicated by characters, in accordance with an order of the characters, namely, as long as it can reproduce, as voices, sounds of words indicated by characters on the basis of the character information. Furthermore, as the technique for generating voices corresponding to character groups as set forth above, any desired one of various technique may be employed, such as a technique which generates waveforms for sounding characters, indicated by the character information, on the basis of waveform information indicative of sounds of various syllables.

Furthermore, the voice control operator may be constructed in any desired manner as long as it can change a factor that is an object of control (object-of-control factor); for example, the voice control operator may be a sensor via which the user can designate variation from a predetermined reference of the object-of-control factor, a value of the object-of-control factor, a state of the object-of-control factor after variation, and/or the like. The voice control operator may be a push-button switch or the like rather than a touch sensor. Furthermore, although it is only necessary that the voice control operator be at least capable of controlling the manner of generation of a voice indicated by a character selected by the character selector, the voice control operator is not so limited, and the voice control operator may be configured to be also capable of controlling the manner of generation of a voice independently of selection by the character selector.

Figure 7:
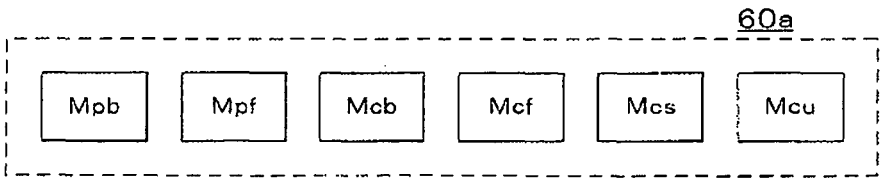
FIG. 7 is a plan view showing another example of a character selector provided on the controller.
Figure 8:
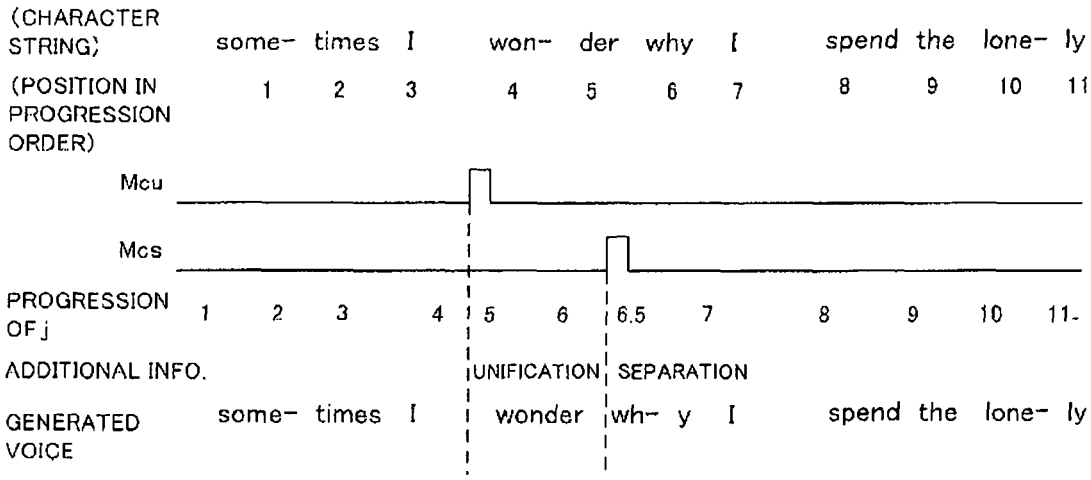
FIG. 8 is a diagram showing examples of a syllable unification process and a syllable separation process performed in response to operations of the character selector of FIG. 7.

What is more, the character selector 60*a* may include one or more other types of character selection (designation) means in addition to the aforementioned four types of selection buttons Mcf, Mcb, Mpf and Mpb. FIG. 7 shows such a modification of the character selector 60*a*. As shown in FIG. 7, the character selector 60*a* includes a syllable separation selector Mcs and a syllable unification selector Mcu in addition to the aforementioned four types of selection buttons Mcf, Mcb, Mpf and Mpb. The syllable separation selector Mcs is operable by the user to instruct that the lyrics progress with a predetermined character group separated, for example, in two syllables. The syllable unification selector Mcu is operable by the user to instruct that a plurality of, such as two, successive character groups be unified to be sounded as a single voice. FIG. 8 shows an example of syllable separation and syllable unification control by the syllable separation selector Mcs and the syllable unification selector Mcu, assuming a case where voices corresponding to a lyrics character string as shown in FIG. 6B are to be generated. In the illustrated example of FIG. 8, the syllable unification selector Mcu has been turned on before the start of generation of a voice of the character group "won" of position "4" in the progression order. The CPU 20 sets a "unification" flag as additional information in response to the turning-on of the syllable unification selector Mcu and then performs a syllable unification process in response to acquisition of pitch designation information immediately following the turning-on of the syllable unification selector Mcu. In the syllable unification process, a modification of the operation of step S105 (FIG. 3B) is performed such that the character group "won" indicated by the current value "4" of the pointer j and the character group "der" corresponding to the next position "5" in the progression order are unified to generate a voice of a plurality of syllables, and a modification of the operation of step S120 (FIG. 3B) is performed such that value "2" is added to the current value "4" of the pointer j to increment the value of the pointer j by two. In this manner, the syllable unification selector Mcu functions as a unification selector for instructing that a plurality of successive character groups included in a pre-defined character string be unified and a voice of the thus-unified successive character groups be generated at one generation timing.

Also, in the illustrated example of FIG. 8, the syllable separation selector Mcs has been turned on before the start of generation of the voice of the character group "why" of position "6". The CPU 20 sets a "separation" flag as additional information in response to the turning-on of the syllable separation selector Mcs and then performs a syllable separation process in response to acquisition of pitch designation information immediately following the turning-on of the syllable separation selector Mcs. In the syllable separation process, a modification of the operation of step S105 (FIG. 3B) is performed such that the character group "why" indicated by the current value "6" of the pointer j is separated into two syllables "wh-" and "y" and a voice of the first syllable (character group) "wh" of the separated syllables is generated, and a modification of step S120 (FIG. 3B) is performed such that value "0.5" is added to the current value "6" of the pointer j to set the value of the pointer j at a broken value of "6.5". Then, in response to acquisition of the next pitch designation information, a voice of the second syllable (character group) "y" of the separated separated syllables is generated, and value "0.5" is added to the current value "6.5" of the pointer j to set the value of the pointer j at value "7". After that, the syllable separation process is brought to an end, and a voice of the character group "I" corresponding to the value "7" of the pointer j is generated in response to acquisition of the next pitch designation in formation. In the syllable separation process, even where the character group to be subjected to the syllable separation comprises a single character (e.g., "I"), a voice of that character group is generated with the character group separated in two syllables (e.g., "a" and "i") if such syllable separation is possible. If such syllable separation is impossible by any means, on the other hand, only a voice of the first syllable may be generated with no voice generated for the second syllable or with the voice of the first syllable sustained. In this manner, the syllable separation selector Mcs functions as a separation selector for instructed that a voice of a character group comprising one or more characters included in a pre-defined character string be separated into a plurality of separated syllables and a voice of each of the separated syllables be generated at a different generation timing.

To summarize the above-described embodiments with regard to the repeat function, the CPU 20 is configured to advance or retreat the pointer j artificially in response to an operation of the character selector 60*a* and/or in response to a progression of an automatic performance sequence and to identify (acquire) a character group, comprising one or more characters, from the pointer j (see steps S102, S105, steps S200 to S220, etc.). Such a function performed by the CPU 20 corresponds to a function as an information acquisition section that acquires information designating one or more characters included in a pre-defined character string.

Further, the CPU 20 is configured to generate a voice, corresponding to a character group of a position in the progression order designated by the pointer j, with a pitch designated as above (step S105). The thus-generated voice is output from the sound output section 70. Such a function performed by the CPU 20 corresponds to a function as a voice generation section that generates a voice of the designated one or more characters on the basis of the acquired information.

Further, as shown in FIG. 4B, the CPU 20 performs the process for setting, in response to a user's operation, a range of a character string as an object of repeat. Such a function performed by the CPU 20 corresponds to a function as an object-of-repeat reception section that receives information designating a currently-generated voice as an object of repeat. Furthermore, as long as the repeat function is ON, the CPU 20 functions to set the position of the first character group of the object of repeat into the pointer j through the operation of step S425 (FIG. 4B), and return from the end of the object of repeat back to the beginning of the object of repeat to thereby repeat voice generation (step S105). Such a function performed by the CPU 20 corresponds to a function of a repeat control section that controls the voice generation section to repeatedly generate the voice designated as the object of repeat.

The invention claimed is:

1. A manually-operable controller for a voice generation device including a processor, the voice generation device being configured to generate a voice on the basis of one or more designated characters in a pre-defined character string and a pitch designated by a pitch selector manual-operator, the manually-operable controller comprising:

a character selector manual-operator located at a first position on the manually-operable controller and structurally dedicated to be operable by a user, during an outputting of an output voice from a sound output circuit, to designate in real time the one or more designated characters in the pre-defined character string; and a voice control manual-operator located at a second position on the manually-operable controller and structurally dedicated to be operable by the user, during the generation of the generated voice, to control in real time a state of the voice generated on the basis of the one or more characters designated by the character selector manual-operator and the pitch designated by the pitch selector manual-operator, wherein the character selector manual-operator includes a separation selector manual-operator for instructing that a voice of a character group, comprising one or more characters, included in the character string be separated into a plurality of syllables and that a voice of the separated syllables be generated at different timings.

2. The manually-operable controller as claimed in claim 1, which further comprises a grip adapted to be held with a hand of the user, and wherein the character selector manual-operator and the voice control manual-operator are provided on the grip.

3. The manually-operable controller as claimed in claim 2, wherein the character selector manual-operator and the voice control manual-operator are provided on the grip at positions where the character selector manual-operator and the voice control manual-operator are operable with different fingers of the user holding the grip.

4. The manually-operable controller as claimed in claim 3, which is constructed in such a manner that one of the character selector manual-operator and the voice control manual-operator is operable with a thumb of the user and other of the character selector manual-operator and the voice control manual-operator is operable with another finger of the user.

5. The manually-operable controller as claimed in claim 2, wherein the character selector manual-operator and the voice control manual-operator are disposed on different surfaces of the grip.

6. The manually-operable controller as claimed in claim 1, wherein the voice control manual-operator comprises a touch sensor configured to detect a touch operation position on an operating surface of the touch sensor.

7. The manually-operable controller as claimed in claim 1, wherein the character selector manual-operator includes a forward shift selector manual-operator for shifting forward by one or more characters in accordance with a progression order of the character string, and a backward shift selector manual-operator for shifting backward by one or more characters in accordance with the progression order.

8. The manually-operable controller as claimed in claim 1, which further comprises a repeat manual-operator configured to be operable by the user to instruct that a voice corresponding to the designated one or more characters be repeated.

9. A manually-operable controller for a voice generation device including a processor, the voice generation device being configured to generate a voice on the basis of one or more designated characters in a pre-defined character string and a pitch designated by a pitch selector manual-operator, the manually-operable controller comprising:

a character selector manual-operator located at a first position on the manually-operable controller and structurally dedicated to be operable by a user, during an outputting of an output voice from a sound output circuit, to designate in real time the one or more designated characters in the pre-defined character string; and a voice control manual-operator located at a second position on the manually-operable controller and structurally dedicated to be operable by the user, during the generation of the generated voice, to control in real time a state of the voice generated on the basis of the one or more characters designated by the character selector manual-operator and the pitch designated by the pitch selector manual-operator, wherein the character selector manual-operator includes a unification selector manual-operator for instructing that a plurality of successive character groups in the character string be unified and that a voice of the unified character groups be generated at one generation timing.

10. A system comprising:

a voice generation device configured to generate a voice on the basis of one or more designated characters in a pre-defined character string and a pitch designated by a pitch selector manual-operator; and a manually-operable controller comprising:

a character selector manual-operator configured to be operable by a user to designate the one or more designated characters in the pre-defined character string; and a voice control manual-operator configured to be operable by the user to control a state of the voice generated on the basis of the character designated by the character selector manual-operator and the pitch designated by the pitch selector manual-operator, wherein the voice generation device includes a processor configured to:

acquire pitch designation information designating a pitch from the pitch selector manual-operator;

synthesize a voice of the one or more characters, designated in accordance with an operation of the character selector manual-operator, with the pitch designated by the acquired pitch designation information;

control a state of the voice to be generated in accordance with an operation of the voice control manual-operator;

keep a pointer indicative of a position, in the character string, of one or more characters to be designated for synthesis of the voices; and sequentially advance the pointer in response to acquisition of the pitch designation information, and wherein designation of the one or more characters in accordance with the operation of the character selector manual-operator comprises shifting forward or backward the position indicated by the pointer in response to the operation of the character selector manual-operator.

11. The system as claimed in claim 10, wherein the processor is configured to synthesize the voices of the one or more characters, designated by the position indicated by the pointer, with the pitch designated by the acquired pitch designation information.

12. The system as claimed in claim 10, wherein the voice generation device is an electronic musical instrument.

13. The system as claimed in claim 10, wherein the manually-operable controller further comprises a repeat manual-operator operable by the user, and the processor is configured to:

receive information designating, as an object of repeat, a range of one or more voices which are successively generated in the voice generation device;

receive the information designating the range of one or more voices in response to a depression operation on the repeat manual-operator and termination of the depression operation on the repeat manual-operator; and control the voice generation device to repeatedly generate the range of one or more voices designated as the object of repeat.

14. A method for controlling generation of a voice by use of a manually-operable controller, the manually-operable controller including: a character selector manual-operator configured to be operable by a user to designate one or more characters in a pre-defined character string; and a voice control manual-operator configured to be operable by the user to control a state of a voice to be generated on the basis of the character designated by the character selector manual-operator and a pitch designated by a pitch selector manual-operator, the method comprising:

a step of acquiring pitch designation information designating a pitch from the pitch selector manual-operator;

a step of receiving, from the character selector manual-operator, information for designating one or more characters in the character string;

a step of receiving, from the character selector manual-operator, information for controlling a state of a voice to be generated;

a step of synthesizing a voice of the one or more characters, designated in accordance with the information received from the character selector manual-operator, with a pitch designated by the pitch designation information acquired from the pitch selector manual-operator;

a step of controlling a state of the voice to be generated in accordance with the information received from the voice control manual-operator:

a step of keeping a pointer indicative of a position, in the character string, of one or more characters to be designated for synthesis of the voices; and a step of sequentially advancing the pointer in response to acquisition of the pitch designation information, wherein designation of the one or more characters in accordance with the operation of the character selector manual-operator comprises shifting forward or backward the position indicated by the pointer in response to the operation of the character selector manual-operator.

15. The method as claimed in claim 14, wherein the manually-operable controller further comprises a repeat manual-operator operable by the user, and the method further comprises:

a step of receiving information designating, as an object of repeat, a range of one or more voices which are successively synthesized by the step of synthesizing, wherein the information designating the range of one or more voices is received in response to a depression operation on the repeat manual-operator and termination of the depression operation on the repeat manual-operator; and a step of performing control to repeatedly generate the range of one or more voices designated as the object of repeat.

16. A voice generation device comprising a processor configured to:

generate one or more voices corresponding to one or more characters in pre-defined character string;

receive, during the generation of the one or more of voices, information designating in real time, as an object of repeat, a range including at least some of the one or more voices, the range to be successively generated from the voice generation;

receive the information designating the range in response to a depression operation on a repeat manual-operator operable by a user, during the generation of the one or more voices, and termination of the depression operation on the repeat manual-operator, during the generation of the one or more voices; and control the voice generation to repeatedly generate the range designated as the object of repeat, wherein the repeat manual-operator is located at a position on a manually-operable controller and structurally dedicated to be operable by the user to instruct that the range be repeatedly generated.

17. The voice generation device as claimed in claim 16, wherein the processor is configured to:

receive first information designating a first voice group of the range in response to the depression operation on the repeat manual-operator and receive second information designating a last voice group of the range in response to the termination of the depression operation on the repeat manual-operator; and control the voice generation to repeatedly generate, as the object of repeat, the designated first voice group to the designated last voice group of the range to be successively generated from the voice generation.

18. The voice generation device as claimed in claim 16, wherein the processor is further configured to:

acquire pitch designation information designating a pitch of a voice to be generated; and generate a voice corresponding to at least some of the one or more characters with the pitch designated by the acquired pitch designation information.

19. A method comprising:

generating one or more voices corresponding to one or more characters in a pre-defined character string;

receiving, during the generation of the one or more voices, information designating in real time, as an object of repeat, a range including at least some of the one or more voices, the range to be successively generated by the step of generating, wherein the information designating the range is received in response to a depression operation on a repeat manual-operator operable by a user, during the generation of the one or more voices, and termination of the depression operation on the repeat manual-operator, during the generation of the one or more voices; and performing control to repeatedly generate the range designated as the object of repeat, wherein the repeat manual-operator is located at a position on a manually-operable controller and structurally dedicated to be operable by the user to instruct that the range be repeatedly generated.

20. A non-transitory computer-readable storage medium storing a group of instructions executable by a processor to perform a voice generation method comprising:

generating one or more voices corresponding to one or more characters in a pre-defined character string;

receiving, during the generation of the one or more voices, information designating in real time, as an object of repeat, a range including at least some of the one or more voices, the range to be successively generated by the step of generating, wherein the information designating the range is received in response to a depression operation on a repeat manual-operator operable by a user, during the generation of the one or more voices, and termination of the depression operation on the repeat manual-operator, during the generation of the one or more voices; and performing control to repeatedly generate the range designated as the object of repeat, wherein the repeat manual-operator is located at a position on a manually-operable controller and structurally dedicated to be operable by the user to instruct that the range be repeatedly generated.

* * * * *